US011404806B2

(12) United States Patent
Chen

(10) Patent No.: US 11,404,806 B2
(45) Date of Patent: Aug. 2, 2022

(54) CONNECTOR HAVING SHUNT STRUCTURE AND SHUNT DEVICE THEREOF

(71) Applicant: Sung-Yu Chen, Taichung (TW)

(72) Inventor: Sung-Yu Chen, Taichung (TW)

( * ) Notice: Subject to any disclaimer, the term of this patent is extended or adjusted under 35 U.S.C. 154(b) by 0 days.

(21) Appl. No.: 17/213,177

(22) Filed: Mar. 25, 2021

(65) Prior Publication Data

US 2021/0305732 A1 Sep. 30, 2021

Related U.S. Application Data

(60) Provisional application No. 63/021,096, filed on May 7, 2020, provisional application No. 63/000,494, filed on Mar. 27, 2020.

(30) Foreign Application Priority Data

Feb. 26, 2021 (TW) ..... 110106949

(51) Int. Cl.
*H01R 12/70* (2011.01)
*H01R 13/424* (2006.01)
*H01R 12/71* (2011.01)

(52) U.S. Cl.
CPC ..... *H01R 12/7088* (2013.01); *H01R 12/71* (2013.01); *H01R 13/424* (2013.01)

(58) Field of Classification Search
CPC .... H01R 12/7088; H01R 12/70; H01R 12/71; H01R 12/778; H01R 13/424; H01R 13/42; H01R 13/40
USPC ..... 439/650
See application file for complete search history.

(56) References Cited

U.S. PATENT DOCUMENTS 5,158,471 A * 10/1992 Fedder ..... H01R 12/58 439/947
8,894,436 B2 * 11/2014 Su ..... H01R 25/006 439/501
9,337,597 B2 * 5/2016 Daamen ..... H01R 27/02
2009/0142953 A1 * 6/2009 Patel ..... H01R 12/7088 439/345
2011/0081798 A1 * 4/2011 Koreeda ..... G02B 6/3825 439/650
2012/0282814 A1 * 11/2012 Houdek ..... H01R 25/00 439/650
2015/0009607 A1 * 1/2015 Daamen ..... H01R 12/7088 361/640
2021/0351531 A1 * 11/2021 Chen ..... H01R 13/642

* cited by examiner

*Primary Examiner* — Harshad C Patel
(74) *Attorney, Agent, or Firm* — Li & Cai Intellectual Property Office

(57) ABSTRACT

A connector having a shunt structure and a shunt device thereof are provided. The connector includes an insulating housing having a first and a second side surface, a plurality of electrical terminals, and a first shunt socket. The first side surface has a plug input interface provided for insertion of a power supply component along a first direction. Each of the electrical terminals has one of a plurality of first contact portions and one of a plurality of first legs. The first shunt socket is located on a third side surface of the insulating housing and corresponds to a shunt hole of the third side surface. The shunt hole allows a surface of at least one of the electrical terminals to be partially exposed and become a shunt contact surface. When a second connector is inserted into the first shunt socket, the second connector is positioned thereon.

11 Claims, 27 Drawing Sheets

CONNECTOR HAVING SHUNT STRUCTURE AND SHUNT DEVICE THEREOF

CROSS-REFERENCE TO RELATED PATENT APPLICATION

This application claims priorities to the U.S. Provisional Patent Application Ser. No. 63/000,494 filed on Mar. 27, 2020 and 63/021,096 filed on May 7, 2020, and to Taiwan Patent Application No. 110106949 filed on Feb. 26, 2021. The entire content of each of the above identified applications is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector having a shunt structure, and more particularly to a connector that is configured on a circuit board and includes a shunt device. Apart from providing electric current to electronic components through the circuit board, the connector can also shunt the electric current and provide the same to other electronic components through the shunt device.

BACKGROUND OF THE DISCLOSURE

A conventional connector that provides electric current has only one output interface for transmission of the electric current. In particular, a board-end connector transmits the electric current to a circuit board. Then, the electric current is shunted through conducting lines on the circuit board, so as to provide the required electric current to every electronic component on the circuit board. Particularly, in response to a demand for a large electric current, not only is it necessary to enhance a current-carrying capacity of the conducting lines of the circuit board, but a power loss may occur when the electric current is transmitted through the conducting lines of the circuit board.

Therefore, how to increase the electric current provided by the board-end connector through an improvement in structural design has become an important issue to be solved in the field.

SUMMARY OF THE DISCLOSURE

In response to the above-referenced technical inadequacies, the present disclosure provides a connector having a shunt structure, which is capable of additionally dividing and providing electric current to other components when there is only one connector, thereby saving a space of an electronic device.

In one aspect, the present disclosure provides a connector having a shunt structure. The connector includes an insulating housing, a plurality of electrical terminals, and a first shunt socket. The insulating housing has a first side surface and a second side surface. The first side surface has a plug input interface provided for insertion of a power supply component along a first direction, the first side surface is rectangular in shape, a length direction of the first side surface is parallel to a second direction, and the second side surface has an output interface. The first direction is perpendicular to the second direction. Each of the electrical terminals has one of a plurality of first contact portions and one of a plurality of first legs. Each of the first contact portions extends into the plug input interface along the first direction, and each of the first legs extends to the output interface. The first shunt socket is located on a third side surface of the insulating housing and corresponds to a shunt hole of the third side surface. The shunt hole allows a surface of at least one of the electrical terminals to be partially exposed and become a shunt contact surface, and the shunt contact surface is parallel to the second direction. The first shunt socket includes a first positioning member, such that a second connector is positioned on the first shunt socket when the second connector is inserted into the first shunt socket.

In view of the current technical inadequacies, there is also a need to provide a shunt device that is capable of additionally dividing and providing electric current to other components when there is only one connector, thereby saving a space of an electronic device.

In another aspect, the present disclosure provides a shunt device, which is used to be mated with an adapter socket of a connector configured on a circuit board, so as to shunt electric current of the connector. The shunt device includes an insulating housing and a first electric terminal. The insulating housing has a bottom surface. The first electric terminal is fixed on the insulating housing. The first electric terminal has a first contact portion and a first leg that extends out of the insulating housing from the first contact portion, so as to provide a first cable connection surface for being connected to at least one wire cable. The first contact portion is exposed from the bottom surface and has a contact surface that is parallel to the bottom surface, so as to abut against a shunt contact surface of the adapter socket.

One of the beneficial effects of the present disclosure is that, the electric current of the connector having the shunt structure provided by the present disclosure can be transmitted to a second electrical terminal of the second connector through the electrical terminals, and can then be transmitted to other components that require the electric current via the wire cable. In the present disclosure, one single connector can be used for providing the electric current through the circuit board or the second connector.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
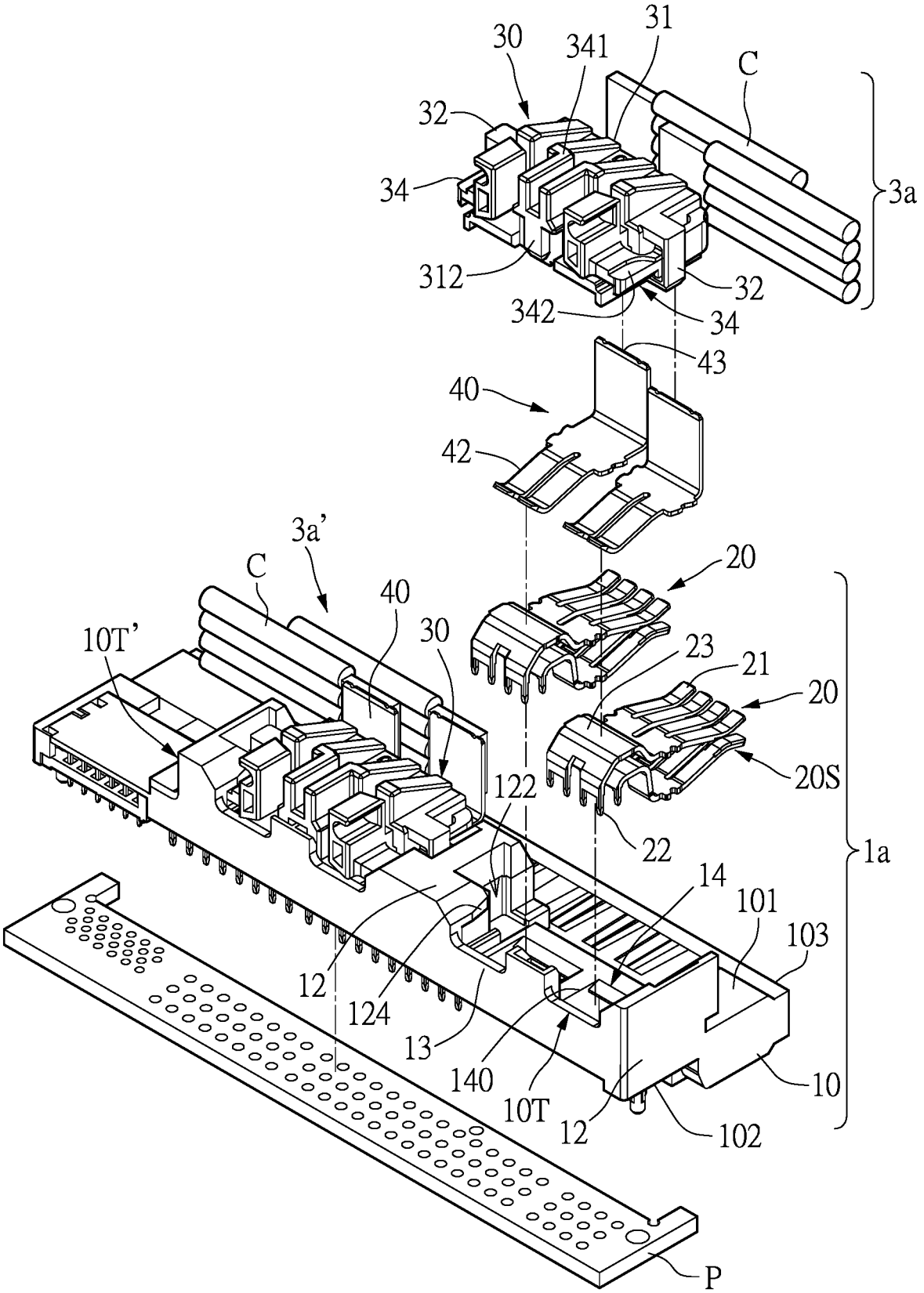
FIG. 1 is a perspective exploded view of a connector assembly having a shunt structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

In the present disclosure, a connector assembly having a shunt structure includes a main connector and a shunt connector. The main connector has an input interface, an output interface, and a shunt interface. The main connector is electrically connected to a power supply component through the input interface located at a first side surface, so as to receive input of electric current or signals and output the received electric current or signals through the output interface located at a second side surface. Further, the received electric current may be partially outputted through the shunt interface located at a third side surface. It should be noted that the first side surface, the second side surface and the third side surface can be a complete surface or a part of a face of the main connector. That is, the first side surface, the second side surface and the third side surface can be located at different faces of the main connector or on the same face. A plurality of electrical terminals is provided in the main connector. An end of the electrical terminals is configured at the input interface, and another end of the electrical terminals is configured at the output interface. In this way, the electric current and/or the signals can be inputted through the input interface, and can then be transmitted to the output interface for output and transmitted to the shunt interface for shunting. Or, there is a plurality of power terminals provided for transmission of the electric current. Through this design, the connector assembly of the present disclosure allows the electric current (i.e., electricity) provided by the power supply component to be shunted in an easy manner, so as to decrease power loss. The power supply component of the connector assembly provided in the present disclosure can be components that are capable of providing the electric current (such as a matching connector or a power supplier), and thus allows for a wide range of application. The present disclosure will be illustrated by various embodiments described below. While naming of components may differ from one embodiment to another due to different application scenarios, the shunting function of the connector assembly is not affected.

First Embodiment

Figure 2:
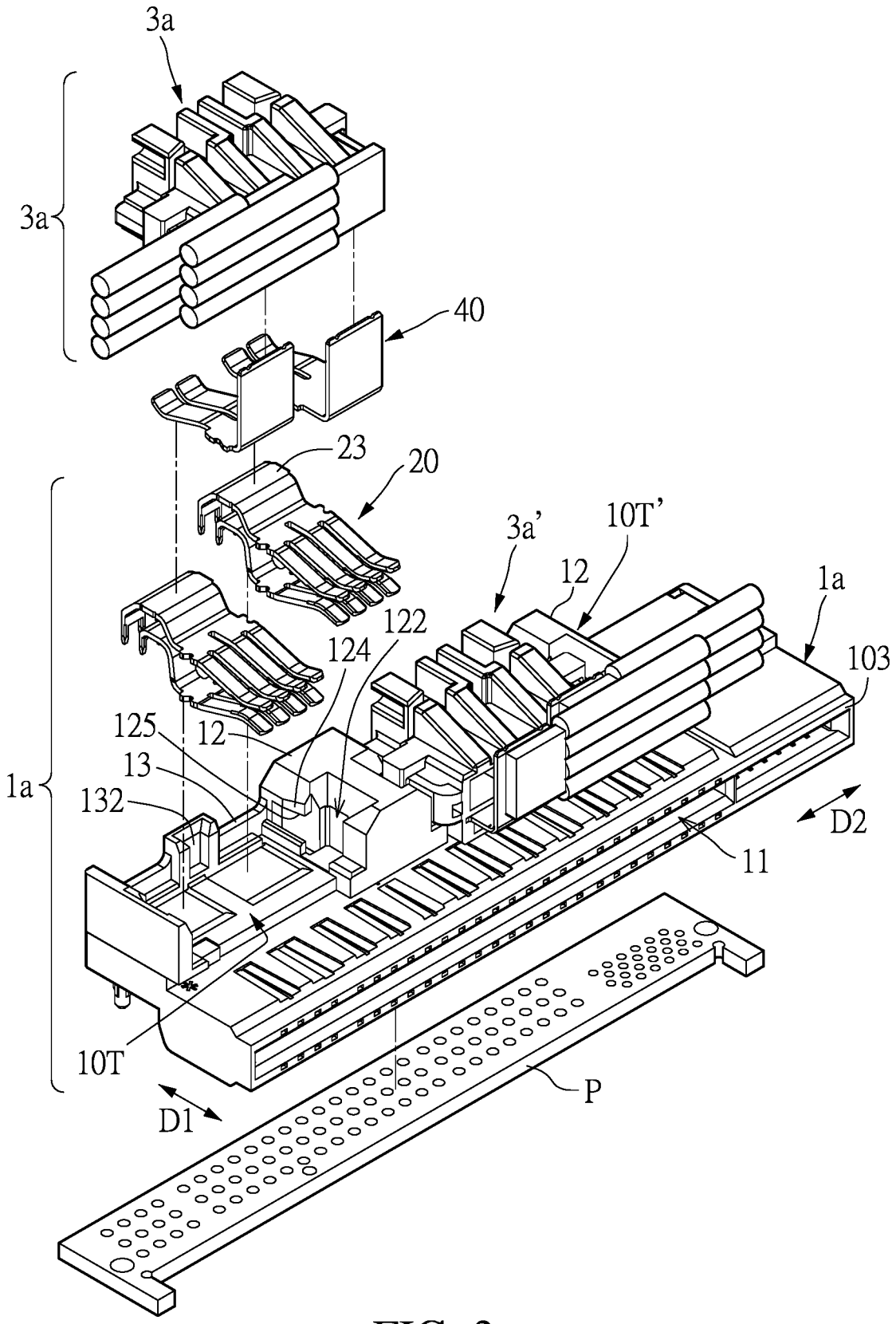
FIG. 2 is another perspective exploded view of the connector assembly having the shunt structure according to the first embodiment of the present disclosure.
Figure 3:
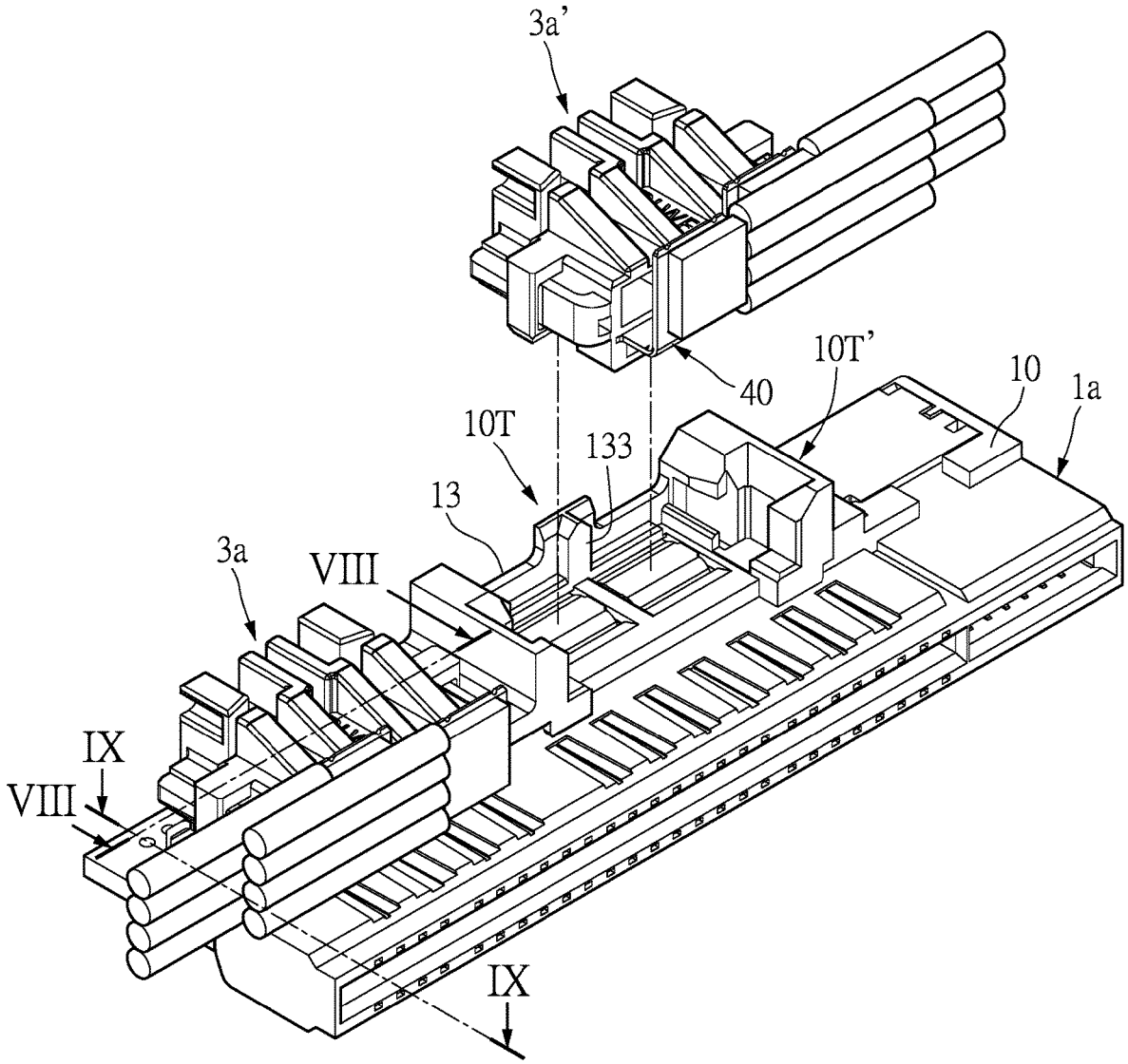
FIG. 3 is a partial perspective exploded view of the connector assembly having the shunt structure according to the first embodiment of the present disclosure.

Referring to FIG. 1 to FIG. 3, a first embodiment of the present disclosure provides a connector assembly having a shunt structure, which includes a first connector 1*a*, a second connector 3*a*, and a third connector 3*a*'. The first connector 1*a* includes a first insulating housing 10, a plurality of first electrical terminals 20, and two adapter sockets 10T, 10T'. The first insulating housing 10 has a first side surface and a second side surface. The first side surface is rectangular in shape, and a length direction of the first side surface is parallel to a second direction D2 (as shown in FIG. 2). The first side surface has a plug side 103 that provides a plug input interface, so as to be electrically connected to a matching component (e.g., a power supply component). The second side surface has an output interface, which is used to output electric current and/or signals provided by the matching component. The first connector 1*a* may be called a connector having a shunt structure. In addition, the second connector 3*a* may be called a shunt device. The shunt device is mated with an adapter socket, so as to shunt electric current of the connector.

In the present embodiment, the first insulating housing 10 further has a top surface 101 and a bottom surface 102 opposite to the top surface 101. The first connector 1*a* is connected to a circuit board P. The input interface is a slot 11, and the output interface is located at the bottom surface 102. The slot 11 is communicated with the plug side 103 and the bottom surface 102. The slot 11 allows the matching component (not shown in the figures) to insert along a first direction D1 (as shown in FIG. 2), and the first direction D1 is perpendicular to the second direction D2. The matching component can be a matching connector or an output end of a power supplier, such as a card edge interface of an output end of a power supplier adopting the CRPS (common redundant power supply). In other words, the slot 11 is a plug input interface of a card edge, a power board, or a busbar. The slot 11 can function as a power input interface and/or a signal input interface. Or, a plurality of the slots 11 may respectively function as the power input interface or the signal input interface. Each of the first electrical terminals 20 has a first contact portion 21 that extends into the slot 11 (i.e., the plug input interface) and a first leg 22 that extends to the bottom surface 102 of the first insulating housing 10 (i.e., the output interface). The first contact portions 21 and the first legs 22 are electrically connected to each other. In the present embodiment, the bottom surface 102 of the first insulating housing 10 functions as a power output interface and/or a signal output interface.

In the present embodiment, the first contact portions 21 of the first electrical terminals 20 are located at the input interface. The first contact portions 21 can jointly define at least one planar contact surface, which is electrically connected to the matching component when the matching component is inserted thereinto. For example, the first contact portions 21 jointly form one planar contact surface that is parallel to the circuit board P (that is, the planar contact surface is parallel to the first direction D1 and the second direction D2). Alternatively, the first contact portions 21 respectively form a plurality of the planar contact surfaces that are perpendicular to the circuit board P (that is, the planar contact surfaces are perpendicular to the second direction D2). The first contact portions 21 are electrically and respectively connected to a power potential or a ground potential of the matching component. The input interface may be defined by the electrical terminals that are arranged in pairs. Referring to FIG. 1, first mating terminals 20S are provided below the first electrical terminals 20. The first electrical terminals 20 and the first mating terminals 20S that are arranged in pairs each have a first side contact portion and a second side contact portion, which jointly form one planar contact area and define a slot therebetween. Such a configuration allows for insertion of the matching component, e.g., terminals of a plug connector, a power board, or a busbar. That is, the matching component has a plate-like terminal or a plurality of terminals arranged on the same plane, or has a plurality of terminals each having at least one planar contact surface, so as to be mated with the input surface of the connector assembly of the present disclosure. The input interface may have one or more slots that is parallel to the second direction D2, or can be multiple slots that are perpendicular to the second direction D2 (but parallel to the first direction D1). However, the present disclosure is not limited thereto. The first electrical terminals 20 can be one-sided. In applications where high power is required, a thickness of the first electrical terminals 20 (i.e., a thickness that is perpendicular to a direction of the slot) is greater than or equal to 0.3 mm, and preferably greater than or equal to 0.6 mm. To prevent excessive insertion force, the thickness of the first electrical terminals 20 is less than or equal to 2 mm, and preferably less than or equal to 1 mm. In this way, the first electrical terminals 20 are much improved and have a balance between the normal force when being combined with the matching component and the ability to provide the electric current. In addition, each of the first contact portions 21 of the first electrical terminals 20 (and second contact portions of the first mating terminals 20S) can include a plurality of elastic arms, so as to prevent any excessive insertion force. In addition, in an application where there is only one slot, significant differences between insertion forces at two ends of the contact surface of the slot which are caused by slanting of the planar contact surface due to assembly tolerance can be prevented.

The first legs 22 of the first electrical terminals 20 extend out of the second side surface, and form one output interface that is connected to the circuit board P. The method of connection can be welding or press fit. Therefore, the first legs 22 can be welding pins or press-fit pins. When the first legs 22 are welding pins, the first legs 22 are connected to the circuit board P by through-hole welding and/or surface mount technology. The first connector 1*a* can be connected to the circuit board P in a vertical manner or a right-angle manner. That is, the first legs 22 can have 90-degree bent portions or can be in a linear shape. When the first legs 22 are in a linear shape (not shown in the figures), the second side surface and the first side surface are oppositely located. At this time, the first direction D1 is perpendicular to a surface of the circuit board P, and insertion of the matching component is along the first direction D1. When the first legs 22 have 90-degree bent portions (as shown in FIG. 1 and FIG. 2), the second side surface is located at the bottom surface 102. The bent portions may be inside the insulating housing 10, so as to protect and support (or fix) the first legs 22. At this time, the first direction D1 is parallel to the surface of the circuit board P, and insertion of the matching component is along the first direction D1. In the present embodiment, the first connector 1*a* is connected to the circuit board P in an offset manner. That is to say, the bottom surface 102 has a first bottom surface area and a second bottom surface area (the second side surface), and the first legs 22 extend outward from the second bottom surface area. A distance between the second bottom surface area and the top surface 101 is preferably less than a distance between the first bottom surface area and the top surface 101, so as to reduce an overall height of the first connector 1*a* being connected to the circuit board P. The top surface 101 may be an even surface, or may be divided into a first top surface area and a second top surface area of different height levels. The first top surface area and the first bottom surface area are oppositely located, and the second top surface area and the second bottom surface area are oppositely located.

The adapter socket 10T is used as a shunt socket and is located on a third side surface of the first insulating housing 10, so as to allow the second connector 3*a* (or called a shunt connector) to be detachably connected to the first connector 1*a* and allow a second electrical terminal of the second connector 3*a* to be electrically connected to at least some of the first electrical terminals 20 of the first connector 1*a*. The third side surface is preferably a surface on a face different from where the first side surface of the input interface of the first connector 1*a* is on and from where a surface of the second side surface of the output surface is on. For example, the first side surface is a front side surface, the second side surface is a bottom surface, and the third side surface can be a top surface or a rear side surface that is opposite to the front side surface. In the embodiment of FIG. 1, the adapter socket 10T is located on the top surface 101.

In the present embodiment, the top surface 101 of the first insulating housing 10 has two identical adapter sockets, which can be called a first adapter socket (10T) and a second adapter socket (10T'), respectively. The first adapter socket 10T is provided for insertion of the second connector 3*a*, and the second adapter socket 10T' is provided for insertion of the third connector 3*a*', so as to be electrically connected to at least one of the electrical terminals. The adapter socket 10T has two limiting side walls 12, and is rectangular in shape. The two limiting side walls 12 are preferably short side walls. The top surface 101 has a shunt hole thereon, and an exposed area 14 is formed between the two limiting side walls 12. That is to say, the shunt hole of the top surface 101 that corresponds to the adapter socket 10T allows a shunt slot defined by the two limiting side walls 12 to be in spatial communication with the input interface and the output interface, and at least one of the first electrical terminals 20 is exposed from the exposed area 14. Specifically, the first electrical terminals 20 have a middle portion 23. The middle portion 23 of the first electrical terminal 20 that corresponds to the exposed area 14 is partially exposed to be a shunt contact surface or an outer contact portion, so as to be electrically connected to the second connector 3*a* when the second connector 3*a* is inserted into the adapter socket 10T. The middle portion 23 is exposed from the exposed area 14. The middle portion 23 is located between the first contact portions 21 and the first legs 22. The middle portion 23 of the present embodiment is planar in shape. The middle portion 23 has a first contact surface that is parallel to the second direction D2. In other words, the first electrical terminals 20 and the first mating terminals 20S respectively extend from the middle portion 23 to the first side contact portion and the opposite second side contact portion at two corresponding inner sides of at least one input interface (the slot 11) to form one planar contact area. The first legs 22 respectively extend from the middle portion 23 to the bottom surface 102 of the first insulating housing 10, and extend out of the second bottom surface to form the output interface and be connected to the circuit board P or the matching connector.

Figure 4:
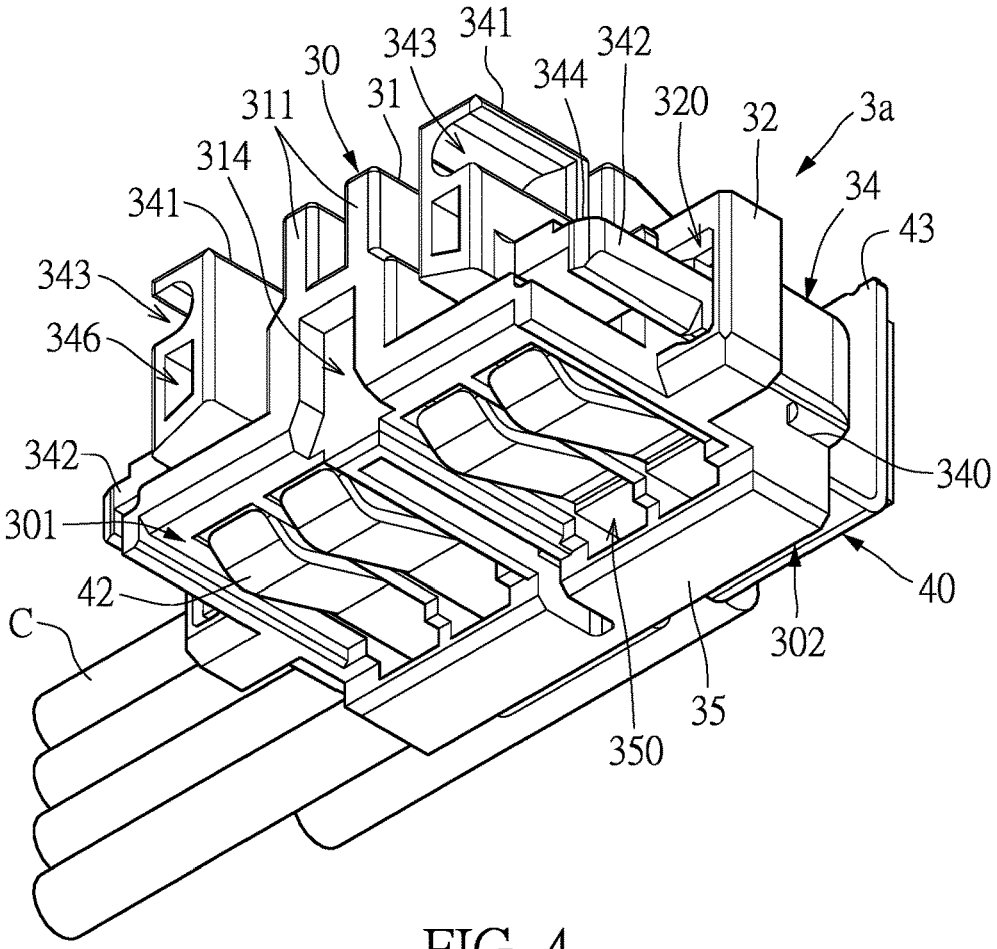
FIG. 4 is a perspective view of a second connector according to the first embodiment of the present disclosure.
Figure 5:
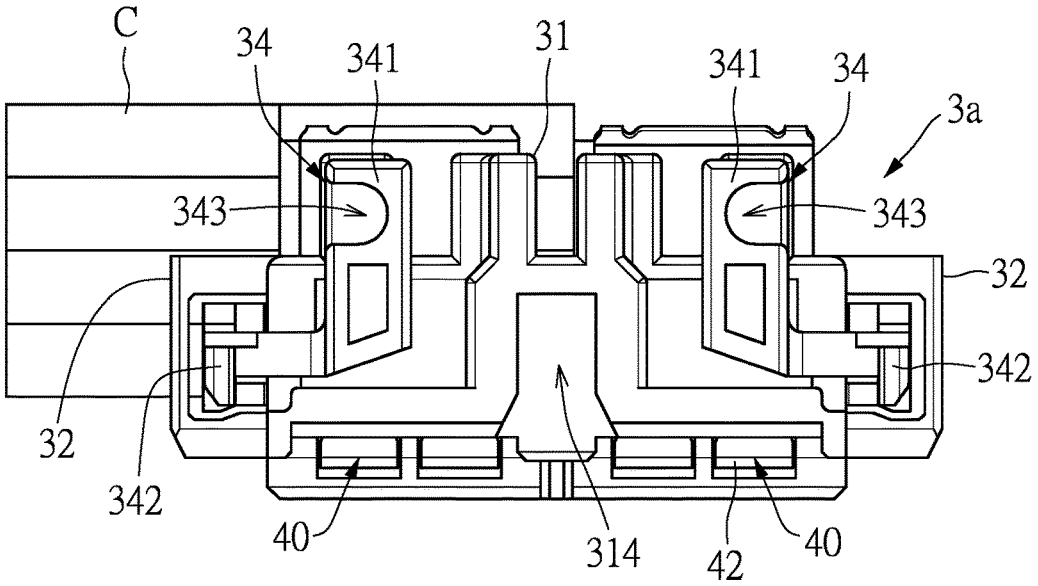
FIG. 5 is a front view of the second connector according to the first embodiment of the present disclosure.
Figure 6:
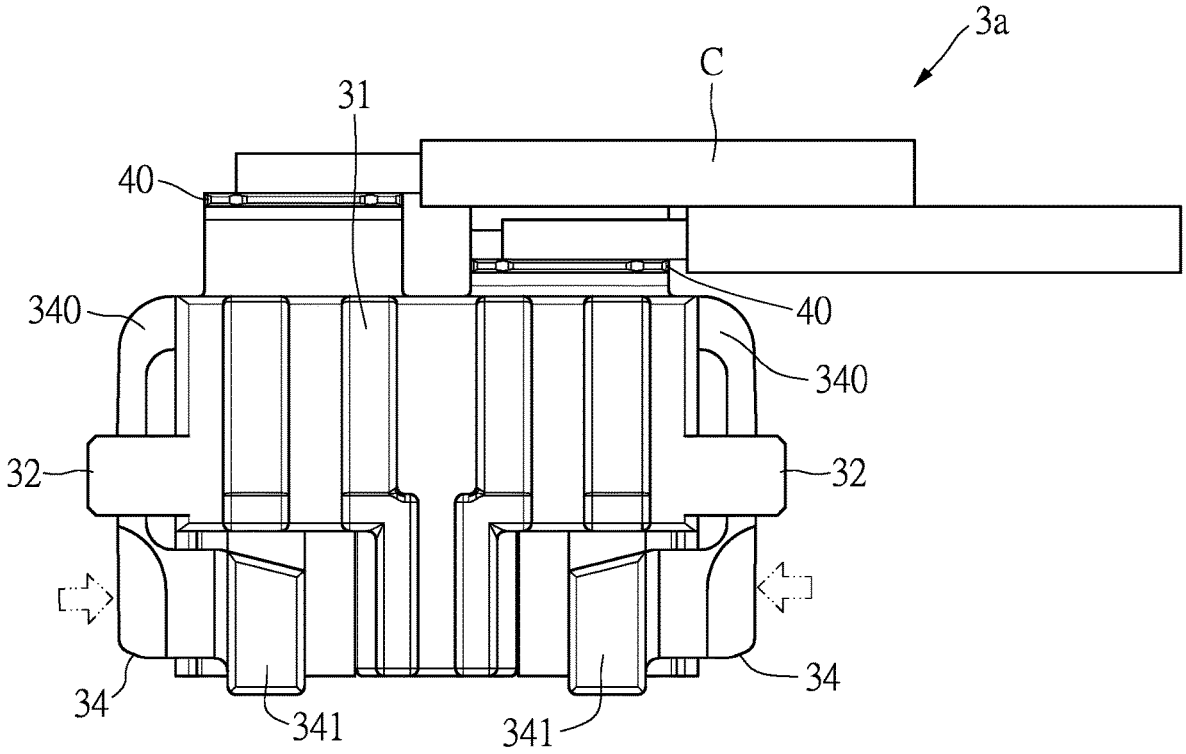
FIG. 6 is a top view of the second connector according to the first embodiment of the present disclosure.

Referring to FIG. 4 to FIG. 7, the second connector 3*a* of the present embodiment as a shunt device is detachably disposed inside the adapter socket 10T. The second connector 3*a* includes a second insulating housing 30 and at least one second electrical terminal 40 that is fixed to the second insulating housing 30. The second electrical terminal 40 has a second contact portion 42 and a second leg 43 that extends from the second contact portion 42. The second contact portion 42 is exposed from a bottom surface of the second insulating housing 30 (or called a shunt input interface 301, as shown in FIG. 4), and has a contact surface that is parallel to the shunt contact surface of the first electrical terminals 20. That is to say, the contact surface of the second contact portion 42 is parallel to the bottom surface of the second insulating housing 30. The second leg 43 (or called a shunt output interface 302, as shown in FIG. 4) is disposed inside the second insulating housing 30 and extends toward a rear end surface thereof (or extends out of the rear end surface of the second insulating housing 30), so as to be connected to at least one wire cable C. The rear end surface and the bottom surface are adjacent and perpendicular to each other. Therefore, when the second connector 3*a* is disposed inside the adapter socket 10T, the contact surface of the second contact portion 42 abuts against the shunt contact surface of the first connector 1*a*, such that the second electrical terminal 40 and the first electrical terminals 20 are electrically connected. Therefore, the electric current of the first electrical terminals 20 is shunted to the second electrical terminal 40, and is then provided to one wire end connector (not shown in the figures) via the at least one wire cable C. The contact portion 42 of the second electrical terminal 40 is preferably exposed from the bottom surface of the second connector 3*a*, and extends into the first insulating housing 10 through the shunt hole (and the exposed area 14) to be electrically connected to the first electrical terminals 20. Furthermore, the second leg 43 of the second electrical terminal 40 is connected to the at least one wire cable C. Preferably, the second leg 43 extends out the second insulating housing 30 and is connected to the at least one wire cable C. To reduce an overall height of the first connector 1*a* being connected to the second connector 3*a*, the second leg 43 can provide a cable connection surface that is parallel to the circuit board P (i.e., being parallel to the first direction D1 and the second direction D2 at the same time), so as to be connected to the at least one wire cable C. In specific application scenarios, a width of a connector is limited in a front-back direction (i.e., the first direction D1). To reduce an overall width of the first connector 1*a* being connected to the second connector 3*a*, the cable connection surface provided by the second leg 43 can be perpendicular to the circuit board P (i.e., being perpendicular to the first direction D1), so as to be connected to the at least one wire cable C. That is to say, the cable connection surface of the second leg 43 can be designed to be parallel to the second contact portion 42 (or the shunt contact surface of the first electrical terminals 20), or be perpendicular to the second contact portion 42 (or the shunt contact surface of the first electrical terminals 20). Referring to FIG. 4 to FIG. 7, the second electrical terminal 40 extends out of the second insulating housing 30, and the second leg 43 is L-shaped and is connected to the at least one wire cable C. The at least one wire cable C can be fixed to the cable connection surface of the second leg 43 by soldering or ultrasonic welding. The at least one wire cable C includes a plurality of conductive fibers. The conductive fibers can be fixed together by soldering or ultrasonic welding beforehand, such that the conductive fibers are adhered to each other and can be conveniently fixed onto the cable connection surface of the second leg 43. Alternatively, after securing the conductive fibers by a jig, the conductive fibers are fixed onto the cable connection surface while adhering to each other by soldering or ultrasonic welding. To prevent a user from suffering an electric shock due to being in contact with a part of the second electrical terminal 40 that is exposed from the second insulating housing 30 and a part of the at least one wire cable C that is exposed from an insulating outer layer, an insulating cover or an insulating layer can be additionally fixed to where the second leg 43 and the at least one wire cable C are connected.

In specific application scenarios, the second electrical terminal 40 as an electrical terminal is capable of transmitting the electric current or the signals. Therefore, the second connector 3*a* is capable of shunting the electric current and transmitting the signals.

Figure 8:
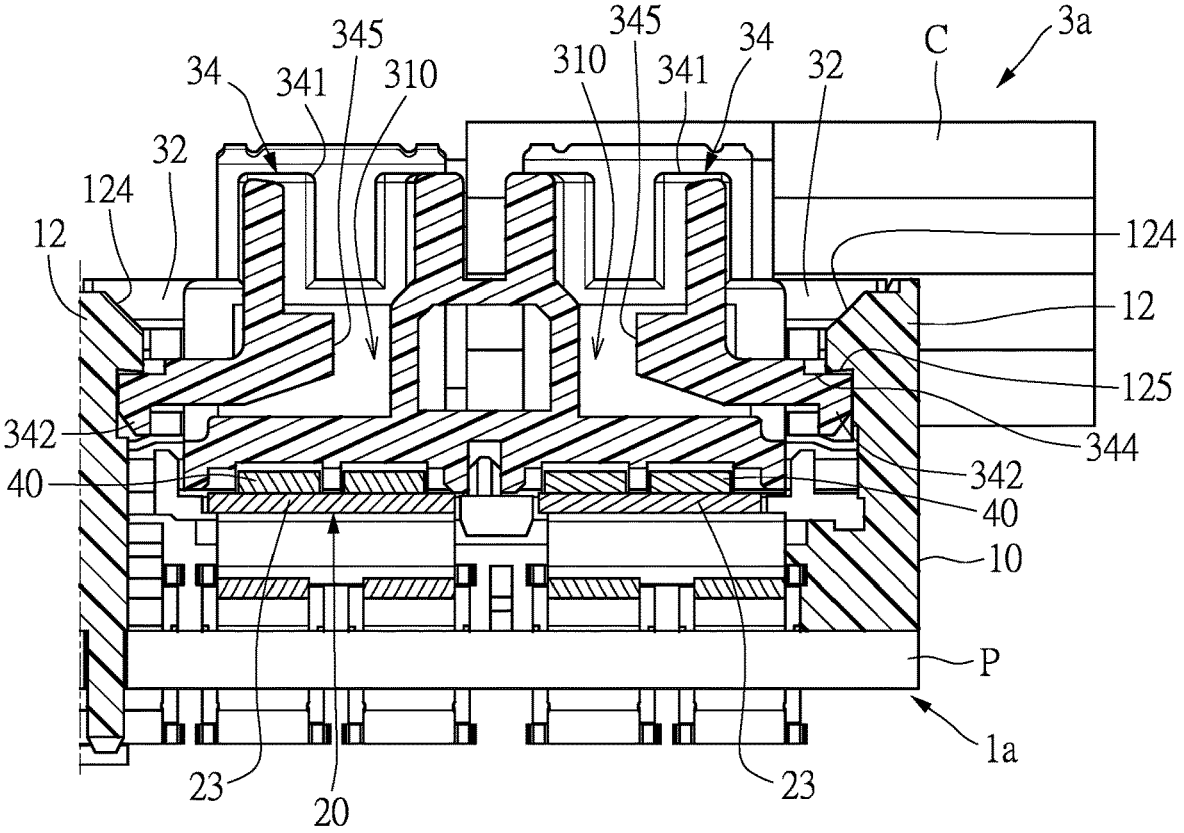
FIG. 8 is a sectional view taken along line VIII-VIII of FIG. 3 according to the present disclosure.

Referring to FIG. 8, the second connector 3*a* of the present embodiment is inserted into the adapter socket 10T in a direction perpendicular to the top surface 101 of the first connector 1*a*. When the second connector 3*a* is inserted into the adapter socket 10T, the second contact portion 42 of the second electrical terminal 40 is in contact with the middle portion 23 of the first electrical terminals 20. At the same time, the second insulating housing 30 is limited between the two limiting side walls 12. Therefore, in the present embodiment, the electric current of the first connector 1*a* can pass through the middle portion 23 of the first electrical terminals 20 so as to be transmitted to the second electrical terminal 40 of the second connector 3*a*, and can then be transmitted to other components that require the electric current via the wire cables C.

Reference is made to FIG. 1, in which the exposed area 14 is located in the adapter socket 10T and has at least one exposed hole 140 formed thereon. The exposed hole 140 is recessed downward from the exposed area 14 and is in spatial communication with the slot 11. The middle portion 23 of the first electrical terminals 20 is exposed from the exposed hole 140. The first electrical terminals 20 exposed from the exposed area 14 include electrical terminals that supply a power potential (such as the first electrical terminals 20 in a first shunt slot on the left side in FIG. 1) and electrical terminals that supply a ground potential (such as the first electrical terminals 20 in a second shunt slot on the right side in FIG. 1).

In another application scenario, the first electrical terminals 20 are exposed from the first shunt slot (or the shunt hole), which include at least one of the electrical terminals that supply a power potential and at least one of the electrical terminals that supply a ground potential. The second connector 3*a* that is disposed in the first shunt slot also includes one second electrical terminal 40 that corresponds to the power potential and one second electrical terminal 40 that corresponds to the ground potential, which are not connected with and are electrically separated from each other (as shown in FIG. 4). Corresponding to one second leg 43 of the electrical terminal that is connected to the power potential and one second leg 43 of the electrical terminal that is connected to the ground potential, the wire cables C respectively supply the power potential and the ground potential to electronic components (e.g., a connector). Accordingly, one single second connector 3*a* may directly provide a current loop to the electronic components that are connected to the second connector 3*a*.

Figure 7:
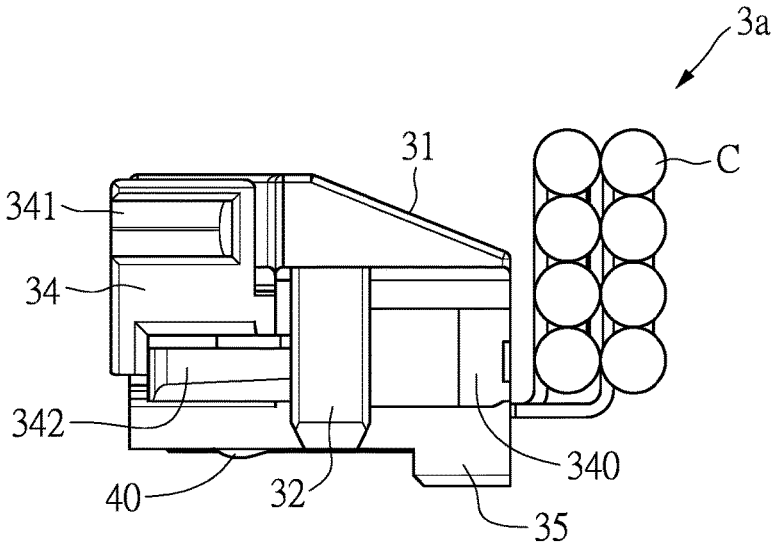
FIG. 7 is a side view of the second connector according to the first embodiment of the present disclosure.

Directions of the wire cables C connected to the second connector 3*a* (i.e., directions of the wire cables C from the cable connection surface of the second leg 43) may be the same or different from each other (e.g., in opposite directions). Referring again to FIG. 4, the multiple wire cables C that are connected to the same second connector 3*a* are oriented to the same direction. Specifically, the same second connector 3*a* is configured to have two (or more) second electrical terminals 40. The second legs 43 of the second electrical terminals 40 extend outward from a side of the second insulating housing 30 (called a pin side in the following description) to different positions (that is, there are different distances between distal ends of the second legs 43 and the pin side of the second insulating housing 30). In this way, when the wire cables C that are connected to the two (or more) second legs 43 are oriented to the same direction, positions of the wire cables C can form a staggered arrangement. That is to say, cable connection surfaces of the two (or more) second electrical terminals 40 are arranged in a staggered manner, such that the wire cables C of the same direction and connected to the cable connection surfaces can form a staggered arrangement. In the embodiment shown in FIG. 4, the second legs 43 have bent portions, which allow the second legs 43 to bend upward. Referring further to FIG. 7, positions of the bent portions are different along a front-back direction (i.e., the first direction D1 shown in FIG. 2), so that the corresponding wire cables C may have the same direction but are arranged differently along the front-back direction. Therefore, the second connector 3a may be connected to the same electronic component when said connector 3*a* has the wire cables C that are oriented to the same direction and simultaneously supply the power potential and the ground potential. In another variation, the positions of the bent portions of the second legs 43 can also be the same, but extended lengths of the bent portions in an upward direction are different. In this way, the connected wire cables C can be oriented to the same direction by having the up and down positions thereof arranged in a staggered manner. Naturally, the multiple wire cables C connected to the same second connector 3*a* are respectively oriented to directions different from one another (i.e., left and right), and there is no need to consider whether or not the positions of the upward-going wire cables C are arranged in a staggered manner. Or, referring to FIG. 3, the two adapter sockets 10T, 10T' are provided on the top surface 101 of the first insulating housing 10, and the two connectors 3*a*, 3*a*' are respectively inserted into the two adapter sockets 10T, 10T'. The wire cables C that are respectively connected to the two connectors 3*a*, 3*a*' are oriented to directions different from one another. While the wire cables C belonging to the connector 3*a* as well as the connector 3*a*' are oriented to the same direction, the wire cables C are parallel to one another and form a staggered arrangement along the same direction.

Referring to FIG4, which is to be read in conjunction with FIG. 7, a protruding seat body 35 is formed from the bottom surface of the second insulating housing 30. At least one terminal fixing hole 350 is formed on the protruding seat body 35. The second electrical terminal 40 passes through the terminal fixing hole 350, and is interferingly fixed to an inner wall surface of the terminal fixing hole 350.

Referring to FIG. 2, the adapter socket 10T further includes a positioning member 132. Referring to FIG. 1, a positioning portion 312 is formed on the second insulating housing 30. When the second connector 3*a* is inserted into the adapter socket 10T, the positioning member 132 and the positioning portion 312 are mated with each other, so as to fix (or limit) a position (or movement) of the second connector 3*a* along at least one direction.

In the present embodiment, the adapter socket 10T further includes a shunt guide portion. The shunt guide portion includes at least one lateral wall 13. The lateral wall 13 is preferably connected to the two limiting side walls 12. The adapter socket 10T is rectangular in shape, the lateral wall 13 is a long side wall, and the limiting side walls 12 are short side walls. At least one of the shunt slots is positioned among the side walls (12, 13) and corresponds to the exposed area 14, such that the middle portion 23 corresponding to the exposed area 14 is exposed to the at least one of the shunt slots. The positioning member 132 is formed by an inner surface of the lateral wall 13 having a recess. The positioning portion 312 is protrudingly formed at a front end surface of the second insulating housing 30, i.e., an end surface that corresponds to a rear end surface of the second leg 43. More specifically, the second insulating housing 30 includes a main body portion 31, and the positioning portion 312 is protrudingly formed at a front end surface of the main body portion 31. However, the present disclosure is not limited thereto. Referring to FIG. 3 and FIG. 4, a positioning member 133 of the adapter socket 10T' protrudes from the lateral wall 13 toward the exposed area 14 in another shunt slot. A positioning portion 314 is formed in a recessed manner at the front end surface of the main body portion 31 of the second insulating housing 30 of the third connector 3*a*'. That is to say, in the present disclosure, the positioning member of the adapter socket and the positioning portion of the second insulating housing may be respectively a groove and a protruding rail that are mated with each other, so as to guide the second connector 3*a* and the third connector 3*a*' to be inserted into the adapter socket 10T and the adapter socket 10T', respectively. The positioning members on the adapter sockets 10T, 10T' may function as mistake-proofing keys, and are different from one another to achieve a mistake-proofing effect by being different in terms of shape, position, or quantity. That is, only the correct second connector 3*a* can be inserted into a first positioning member of the adapter socket 10T. Since other connectors (e.g., the third connector 3*a*') include incompatible positioning portions (or the positioning member is not mated with the positioning portion), a correct or complete insertion cannot take place and so the mistake-proofing effect is achieved. In the present embodiment, the mistake-proofing key is a groove or a protruding rail. The adapter socket 10T supplies a power potential, and the adapter socket 10T' supplies a ground potential. Therefore, the second connector 3*a* is inserted into the adapter socket 10T to supply the power potential, and the third connector 3*a*' is inserted into the adapter socket 10T' to supply the ground potential. Through the design of the mistake-proofing key, an incorrect insertion of the second connector 3*a* and the third connector 3*a*' and supply of wrong electric potentials to the electronic component can then be prevented.

Figure 9:
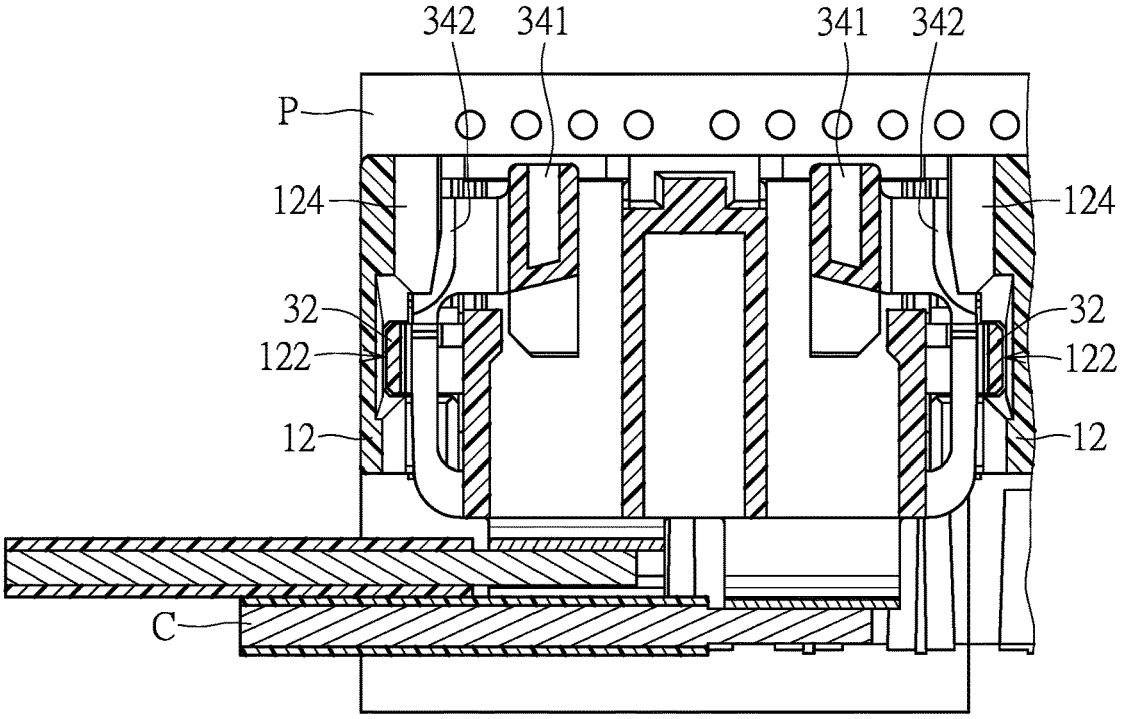
FIG. 9 is a sectional view taken along line IX-IX of FIG. 3 according to the present disclosure.

The two limiting side walls 12 of the adapter socket 10T each have a guide rail 122, and two sides of the second insulating housing 30 each have a guide block 32 formed thereon. At least one vertical guided surface (i.e., being perpendicular to the bottom surface of the second insulating housing 30) is defined by the guide block 32. When the second connector 3*a* is inserted into the adapter socket 10T, at least one guiding surface of the guide rail 122 corresponds to the least one guided surface of the guide block 32, such that the guide block 32 slides into the guide rail 122 (as shown in FIG. 9). Side surfaces of the second insulating housing 30 forming the guide block 32 are preferably two opposite side surfaces that are different from the front end surface and the rear end surface thereof.

Reference is made to FIG. 1 and FIG. 2. The two limiting side walls 12 of the adapter socket 10T each have a clamping portion 124. The two sides of the second insulating housing 30 each have a movable clamping arm 34. When the second connector 3*a* is inserted into the adapter socket 10T, the clamping arms 34 are engaged with the clamping portions 124. That is to say, when the second connector 3*a* is inserted to a clamping position, the clamping arms 34 are engaged with the clamping portions 124. The guide rail 122 and the clamping portion 124 are located on two opposite sides of the two limiting side walls 12. That is, each of the two limiting side walls 12 has one guide rail 122 and one clamping portion 124 respectively located on a first side end and a second side end (which is opposite to the first side end) for each of the two limiting side walls 12. In addition, the clamping portion 124 has a clamping surface 125 that is parallel to the shunt contact surface (i.e., a lower surface of the clamping portion 124 as shown in the embodiment of FIG. 2), so as to provide the second connector 3*a* a normal force that is perpendicular to the shunt contact surface. In this way, when the second contact portion 42 of the second electrical terminal 40 abuts against the shunt contact surface of the first electrical terminals 20, the normal force may be sufficient enough to reduce a contact resistance therebetween. The clamping arm 34 also has a support surface 344 (as shown in FIG. 4) that corresponds to the clamping surface 125, so as to receive the normal force. The support surface 344 is parallel to the bottom surface of the second insulating housing 30.

As shown in FIG. 4, the guide block 32 can also function as a clamping arm protection device, and is connected to a side surface of the second insulating housing 30 in a U-shape, so as to form a protective through hole 320. A fixing end 340 of the clamping arm 34 extends through the protective through hole 320 of the guide block 32 to form a free end. The guide block 32 surrounds a part of the clamping arm 34, thereby limiting a displacement of the clamping arm 34 along a horizontal direction.

A pressing portion 311 is provided on the main body portion 31, and a height of the pressing portion 311 is equal to or greater than a height of the clamping arm 34. The pressing portion 311 is preferably located on a top surface of the main body portion 31, i.e., a top surface of the second insulating housing 30. When the second connector 3*a* is inserted into the adapter socket 10T, the user may press the pressing portion 311 such that the second connector 3*a* is moved to the clamping position. The height of the pressing portion 311 (i.e., a pressing surface) is not lower than the height of the clamping arm 34, so as to prevent an original clamping function of the clamping arm 34 from being affected due to a force applied by the user during a clamping process. As shown in FIG. 4, the pressing portion 311 is formed by extending from a middle of the main body portion 31 in an upward direction, and is located between the two clamping arms 34. The pressing portion 311 can include two or more force application members, so as to define one level (i.e., being parallel to the bottom surface of the second insulating housing 30) pressing surface. In this way, an issue of unbalanced force application on left and right sides when the user applies a pressing force can be prevented. Or, the pressing portion 311 can be one single force application member that has a level upper surface as the pressing surface that has a larger dimension, so as to ensure that a pressing force is balanced.

The clamping arm 34 has a release portion 341 and a fastening portion 342. The fastening portion 342 is formed at the free end of the clamping arm 34. The release portion 341 extends upward from the fastening portion 342, and the release portion 341 and the fastening portion 342 are respectively located on two sides of the clamping arm 34. Specifically speaking, the release portion 341 and the fastening portion 342 are both located at the free end of the clamping arm 34, and the release portion 341 is formed by extending upward from an inner side of the fastening portion 342. The release portion 341 and the fastening portion 342 (i.e., the clamping arm 34) are L-shaped. The aforementioned support surface 344 is located at the free end of the clamping arm 34, or more specifically, on the fastening portion 342 (an outer side of an upper surface of the fastening portion 342). The two release portions 341 are respectively located on two sides of the main body portion 31. When the user is about to remove the second connector 3*a* from the adapter socket 10T, the release portions 341 on the left and right sides are pressed toward the inner side (i.e., the release portions 341 approach toward each other), such that the engagement between the clamping arms 34 and the clamping portions 124 is removed. Further, the second connector 3*a* is completely disengaged from the adapter socket 10T by being pulled upward. A force application portion is provided on an outer side surface of the release portion 341, which allows the outer side surface to be uneven and increases the effect of an upward application of force. In the present embodiment, the force application portion is a force application groove 343 located on the release portion 341.

The adapter socket 10T (and/or the second insulating housing 30) may have a heat dissipation groove or a heat dissipation through hole that is along a front-back direction, so as to increase an overall heat dissipation ability of the adapter socket 10T and the connector assembly. The heat dissipation groove or the heat dissipation through hole can be designed to be perpendicular to a printed circuit board (PCB) or to be parallel to the printed circuit board (PCB). In a perpendicular design, heat dissipation can be increased due to an upward direction of convective heat transfer. In a horizontal design, a horizontal airflow generated by a fan of a system (e.g., a server) in which the adapter connector 10T is disposed can be blown into or be blown through the horizontal (i.e., being parallel to the PCB, which is the bottom surface of the second insulating housing 30) heat dissipation groove or the heat dissipation through hole, thereby taking away heat generated and increasing heat dissipation. Further, the heat dissipation groove or the heat dissipation through hole can also increase a surface area of the adapter socket 10T and the connector assembly, whilst improving the heat dissipation ability. Referring to FIG. 4, a heat dissipation groove 346 is provided on the fastening portion 342, and a heat dissipation groove is configured between the two arm-shaped structures of the pressing portion 311 that are parallel to one another. In addition, the protective through hole 320 not only provides a protection function for the clamping arm 34, but also functions as the heat dissipation through hole to increase the heat dissipation ability.

As shown in FIG. 8, two inner limiting slots 310 are further formed on the second insulating housing 30. The two clamping arms 34 each have an inner limiting portion 345, and the inner limiting portion 345 extends backward from the fastening portion 342 and can be movably extended into the inner limiting slot 310. A displacement of the inner limiting portion 345 along a vertical direction is limited by the inner limiting slot 310. The two inner limiting slots 310 are located at inner sides of the guide blocks 32. Accordingly, the displaced clamping arms 34 along a horizontal and a vertical direction can be properly protected in the present embodiment, thereby preventing improper external force from damaging the clamping arms 34.

In the present embodiment, the release portion 341 of the clamping arm 34 extends in a direction away from the second electrical terminal 40, such that greater safety can be provided and a finger of an operator can be prevented from accidentally touching the second electrical terminal 40. That is to say, the second leg 43 of the second electrical terminal 40 and the clamping arm 34 are located on opposite sides of the second insulating housing 30, so as to increase a distance therebetween and lower a risk of the user suffering an electric shock due to accidentally touching a conductive area.

Second Embodiment

Figure 10:
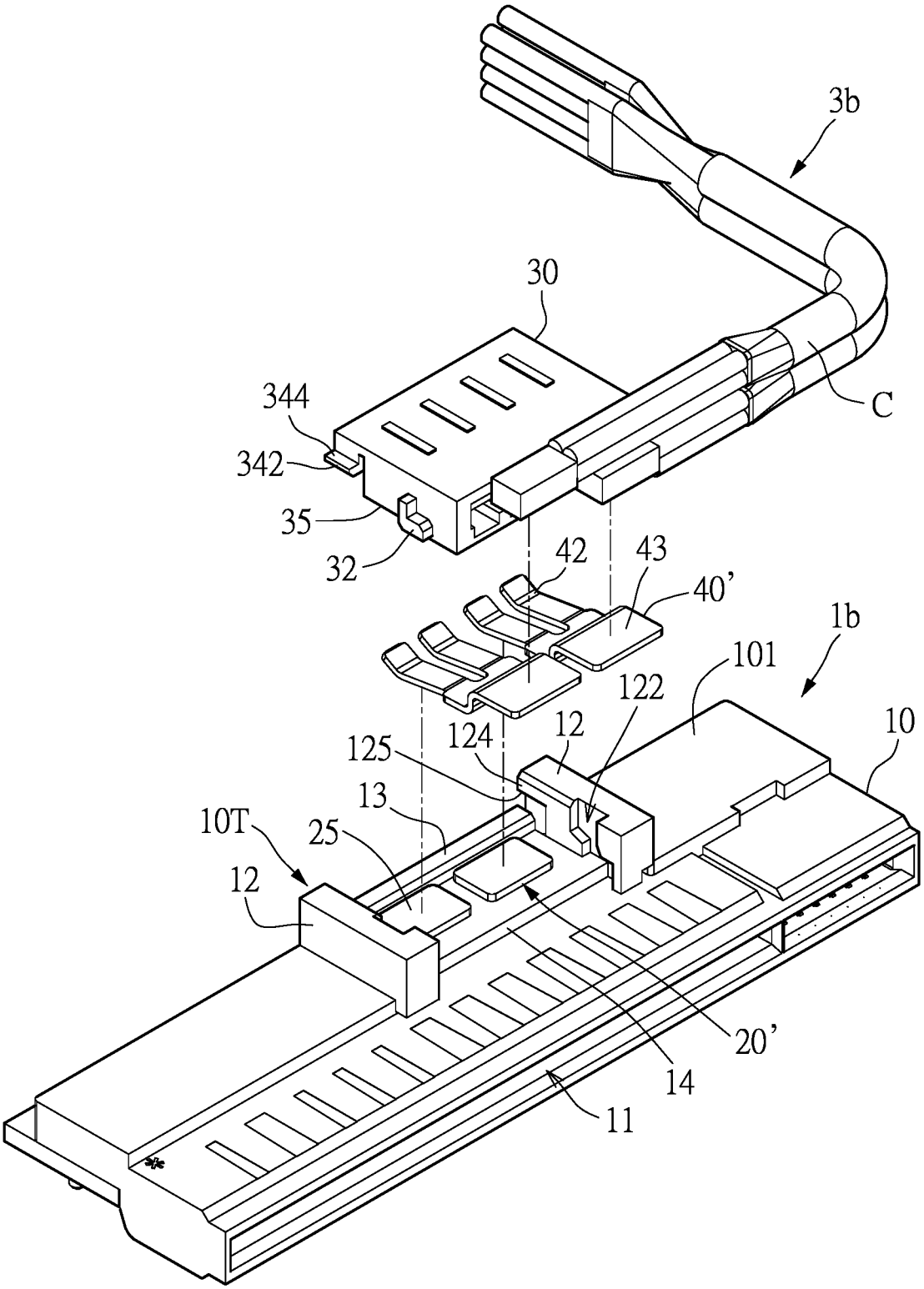
FIG. 10 is a perspective exploded view of the connector assembly having the shunt structure according to a second embodiment of the present disclosure.
Figure 11:
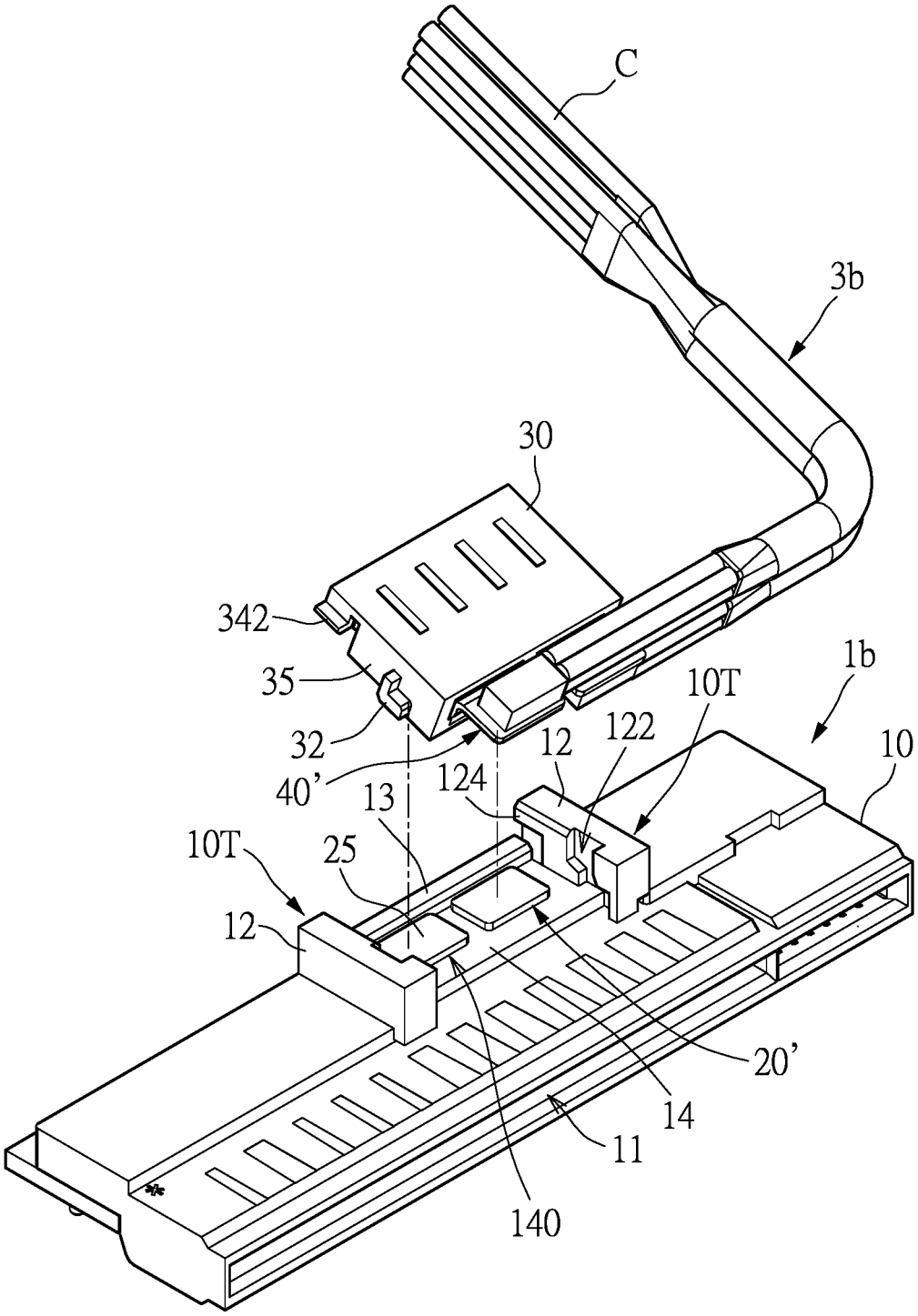
FIG. 11 is a schematic view showing assembling of the connector assembly having the shunt structure according to the second embodiment of the present disclosure.
Figure 12:
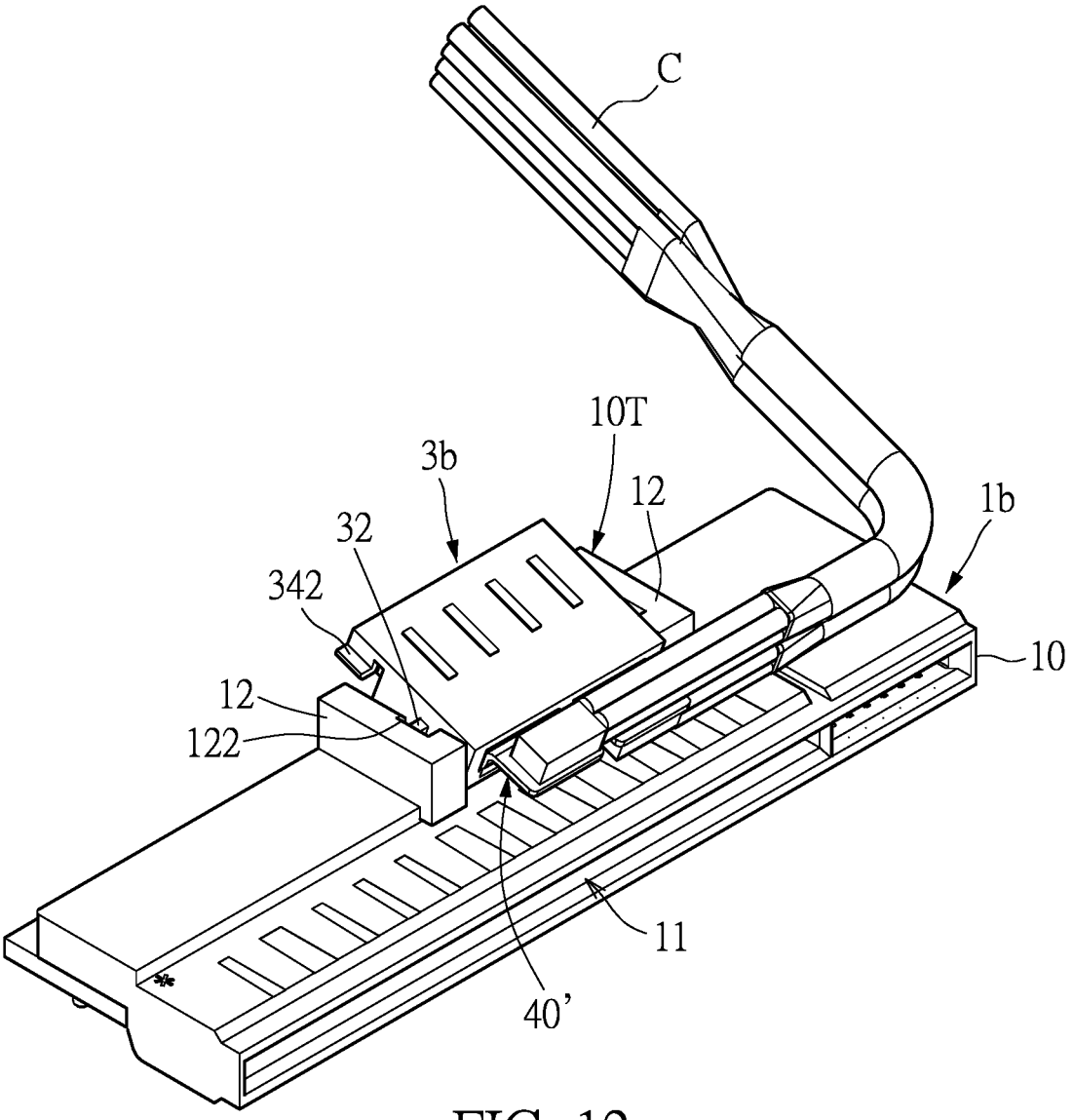
FIG. 12 is a perspective view showing assembling of the connector assembly having the shunt structure being almost completed according to the second embodiment of the present disclosure.
Figure 13:
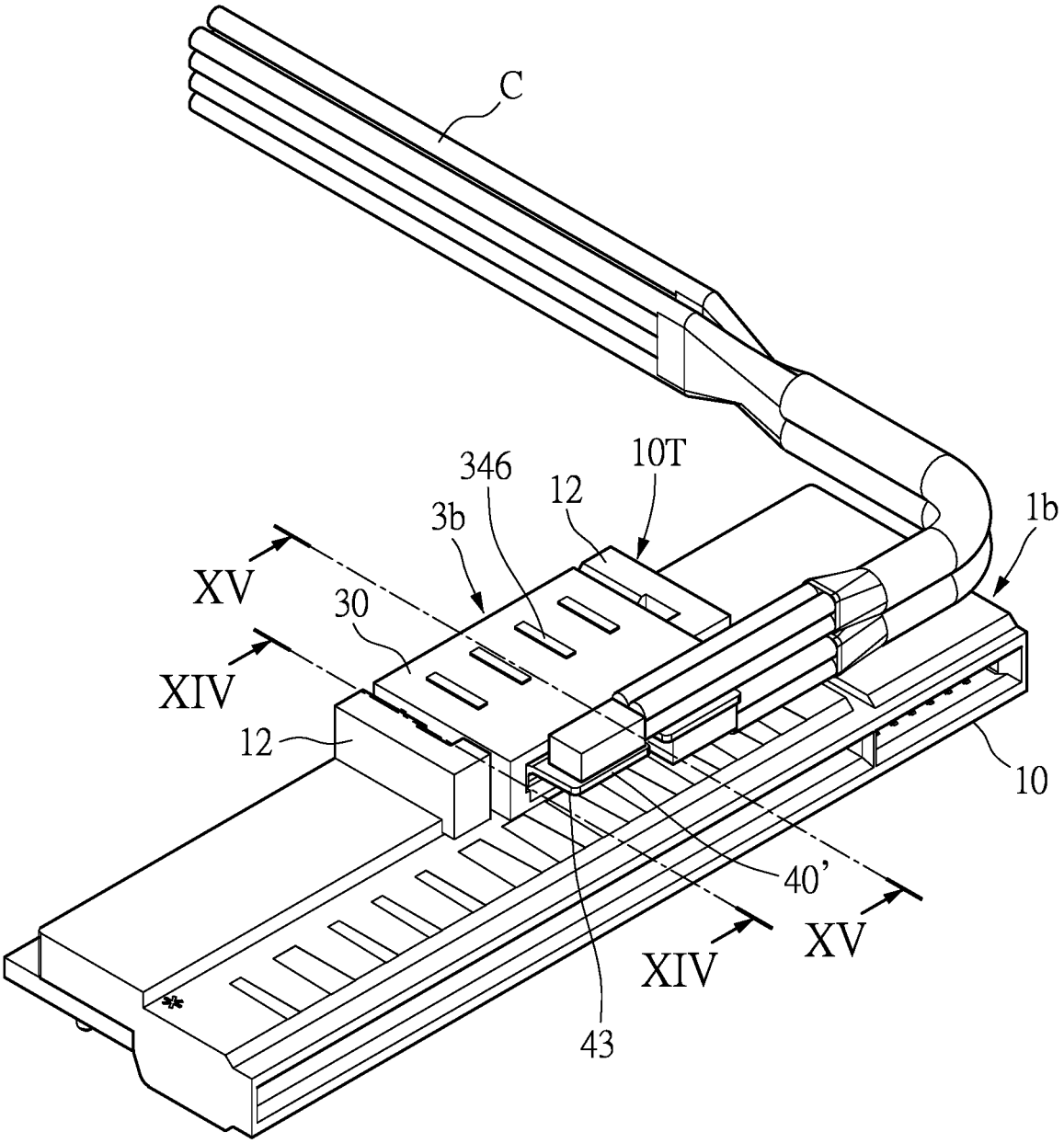
FIG. 13 is a perspective view showing the assembled connector assembly having the shunt structure according to the second embodiment of the present disclosure.
Figure 14:
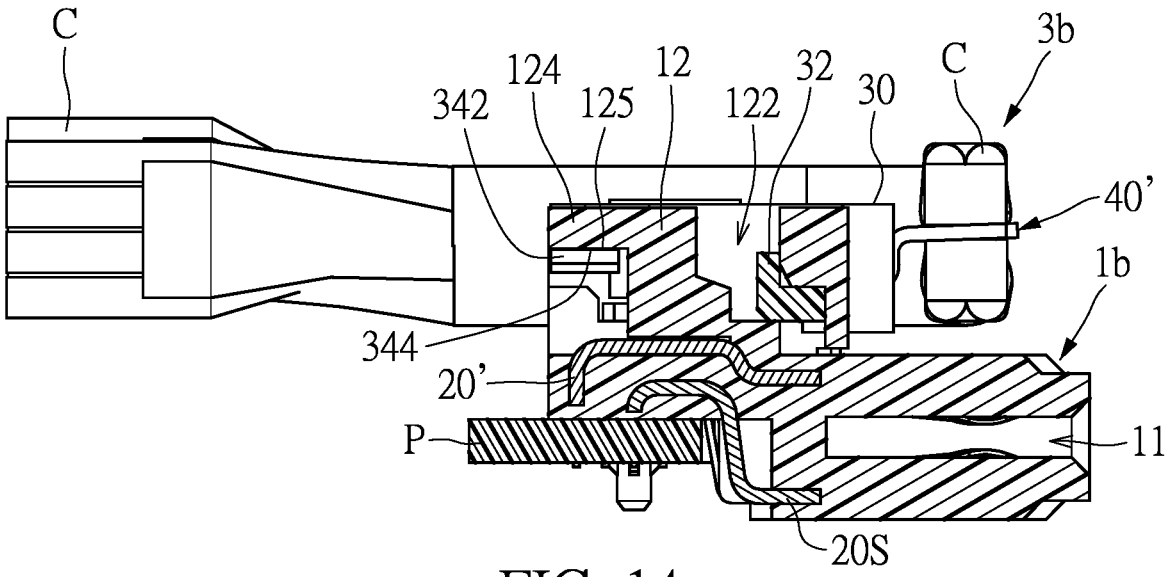
FIG. 14 is a sectional view taken along line XIV-XIV of FIG. 13 according to the present disclosure.

Referring to FIG. 10 to FIG. 15, a second embodiment of the present disclosure provides a connector assembly having a shunt structure, which includes a first connector 1*b* and a second connector 3*b*. The first connector 1*b* includes the first insulating housing 10 and a plurality of first power terminals 20'. Each of the first power terminals 20' is used to conduct an electric current which is greater than or equal to 1 A at its maximum current. The second connector 3*b* includes the second insulating housing 30. What is different from the previous embodiment is that the second connector 3*b* of the present embodiment is obliquely inserted into the adapter socket 10T along a direction that is oblique to a top surface of the first connector 1*b*. The guide rail 122 of the limiting side wall 12 is roughly L-shaped or semi-U shaped. The clamping portion 124 is formed at a front end of the limiting side wall 12 that is near the lateral wall 13. The lower surface of the clamping portion 124 has one clamping surface 125 (as shown in FIG. 10 and FIG. 14) that is parallel to the top surface 101. The guide block 32 of the second insulating housing 30 and the fastening portion 342 are protrudingly formed on two opposite side surfaces. The guide rail 122 is roughly L-shaped or semi-U shaped (that is, a non-linear guide rail), and the fastening portion 342 exhibits an elastic arm shape and has a protrusion protruded outward. An upper surface of the protrusion is the support surface 344.

Figure 15:
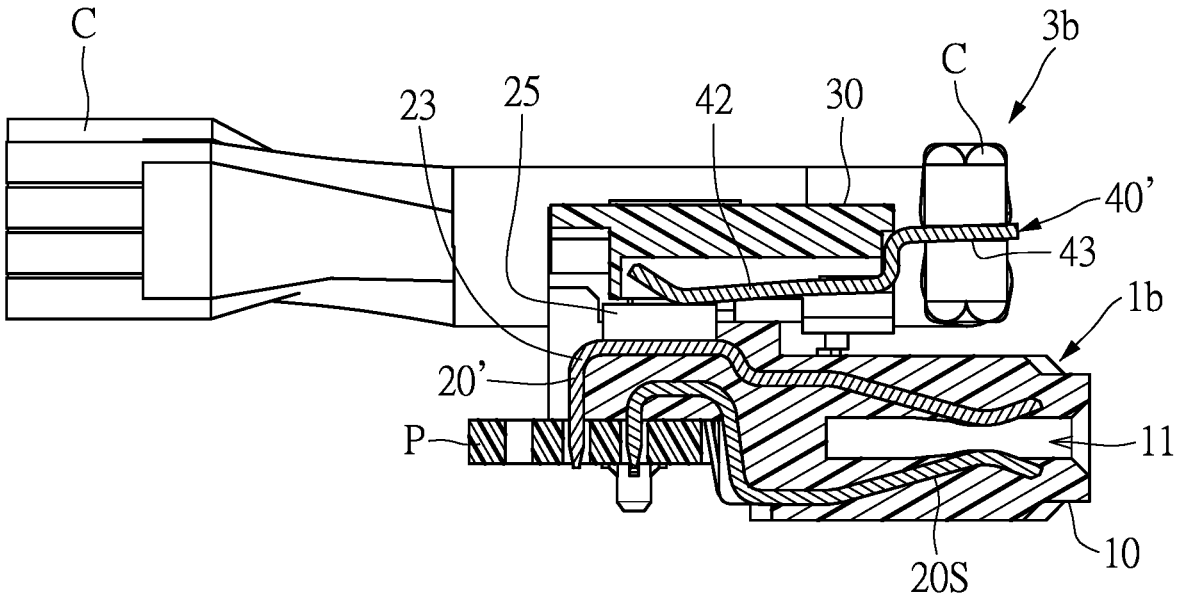
FIG. 15 is a sectional view taken along line XV-XV of FIG. 13 according to the present disclosure.

In the present embodiment, during the assembling process, the second insulating housing 30 of the second connector 3*b* is obliquely inserted into the adapter socket 10T on the top surface of the first connector 1*b* by an angle that is greater than or equal to an assembling angle (i.e., an included angle between the second insulating housing 30 and the top surface 101). The assembling angle is preferably 15 degrees or above, e.g., 30 or 45 degrees. Accordingly, a rear end of the second insulating housing 30 is tilted downward and a front end thereof is tilted upward, so as to allow the guide block 32 to enter into the guide rail 122 of the adapter socket 10T. Then, the front end of the second insulating housing 30 is pressed downward, and the second insulating housing 30 is pushed toward the first connector 1*b* in a horizontal direction (i.e., a direction that is parallel to the top surface 101) when the second insulating housing 30 is almost parallel to the top surface 101 of the first connector 1*b*. In this way, the fastening portion 342 is inserted into the clamping portion 124 of the adapter socket 10T, and the assembling process is then completed. That is to say, after inserting a side of the second connector 3*b* into the adapter socket 10T, an opposite side thereof is inserted into the adapter socket 10T by rotation, and is lastly moved to the clamping position to complete the assembling process of the first connector 1*b* and the second connector 3*b*. The pressing downward action in the assembling process not only allows the first power terminals 20' and second power terminals 40' to be electrically connected, but also allows the first power terminals 20' and the second power terminals 40' to generate a contact normal force on each other. That is, by utilizing an elastic force of deformation of the first power terminals 20' and the second power terminals 40', the contact normal force therebetween is generated. This elastic force also exerts a normal force between the first connector 1*b* and the second connector 3*b*, and is jointly shared by the clamping surface 125 and the support surface 344, as well as the guide block 32 and a bottom portion of the guide rail 122. In this way, the first connector 1*b* and the second connector 3*b* are engaged with each other due to a static frictional force generated therebetween as a result of the normal force. Referring to FIG. 13 to FIG. 15, a complete insertion of the second connector 3*b* into the first connector 1*b* is shown.

As shown in FIG. 10 to FIG. 15, a conducting protrusion 25 may be additionally configured on the first power terminal 20' that corresponds to the exposed area 14 of the adapter socket 10T. That is, the middle portion 23 has the conducting protrusion 25. Therefore, a height of the middle portion 23 of the first power terminal 20' of the exposed area 14 is greater than heights of the middle portions 23 of remaining ones of the first power terminals 20'. Preferably, the conducting protrusion 25 protrudes from a top surface of the exposed area 14. That is to say, in a direction that is perpendicular to the first direction (or the top surface 101 of the first insulating housing 10), an outer height of a shunt contact surface of the first power terminal 20' that corresponds to the exposed hole 140 is greater than heights of corresponding surfaces of the remaining ones of the first power terminals 20'.

The conducting protrusion 25 and the first power terminal 20' can be integrally formed, or can be connected to each other by welding. In other words, a thickness of the middle portion 23 of the first power terminal 20' located in the exposed area 14 of the adapter socket 10T is greater than thicknesses of the middle portions of the first power terminals 20' not in the exposed area 14.

The second legs 43 of the second power terminals 40' extend out of the second insulating housing 30 along a direction that is parallel to the top surface 101. As shown in FIG. 13, a quantity of the second power terminals 40' included by the second connector 3*b* is two. While the second legs 43 are positioned the same, the wire cables C are connected to an upper surface and a lower surface of the second legs 43, respectively. That is, the cable connection surfaces of the second legs 43 are arranged in a staggered manner, such that the wire cables C of the same direction form a staggered arrangement. There is at least one heat dissipation groove 346 (or the heat dissipation through hole) provided on an upper surface of the second connector 3*b*, so as to increase the heat dissipation ability of the second connector 3*b*.

Third Embodiment

Figure 16:
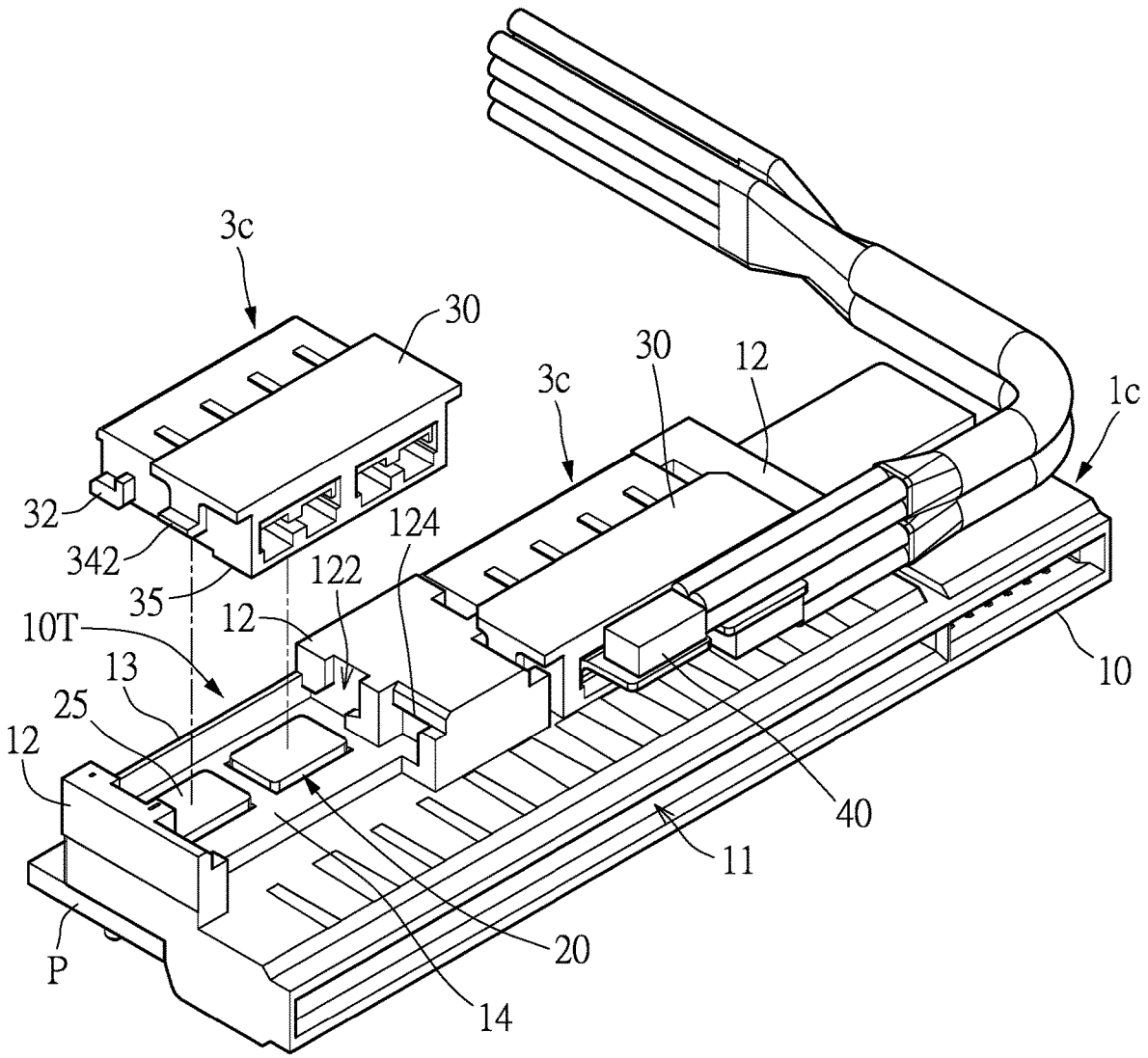
FIG. 16 is a perspective exploded view of the connector assembly having the shunt structure according to a third embodiment of the present disclosure.

Referring to FIG. 16, a third embodiment of the present disclosure provides a connector assembly having a shunt structure, which includes a first connector 1*c* and a second connector 3*c*. The first connector 1*c* includes the first insulating housing 10 and the plurality of first electrical terminals 20. The second connector 3*c* includes the second insulating housing 30.

The guide block 32 of the second insulating housing 30 and the fastening portion 342 are protrudingly formed on two side surfaces. What is different from the previous embodiment in terms of structural design is that the guide block 32 is located at the front end of the second insulating housing 30, and is roughly L-shaped and faces outward. The fastening portion 342 exhibits an elastic arm shape, has a protrusion protruded outward, and is near the rear end of the second insulating housing 30. That is to say, the guide block 32 and the fastening portion 342 located on the same side surface are near another two opposite side surfaces of the second insulating housing 30, respectively. The guide rail 122 of the limiting side wall 12 is roughly L-shaped and is near the lateral wall 13, and the clamping portion 124 is formed at a rear end of the limiting side wall 12 that is distant from the lateral wall 13.

In the present embodiment, during the assembling process, the second insulating housing 30 of the second connector 3*c* is also obliquely inserted into the adapter socket 10T on a top surface of the first connector 1*c* by an angle that is greater than or equal to an assembling angle. When the angle for inserting the second insulating housing 30 is less than the assembling angle, the guide block 32 may not be able to smoothly glide into the guide rail 122. What is different from the previous embodiment is that the front end of the second insulating housing 30 is tilted downward and the rear end thereof is tilted upward, so as to allow the guide block 32 to enter into the guide rail 122 of the adapter socket 10T. Then, the rear end of the second insulating housing 30 is pressed downward, such that the second insulating housing 30 is almost parallel to the top surface of the first connector 1*c* and then enters into the clamping position. In this way, the fastening portion 342 is inserted into the clamping portion 124 of the adapter socket 10T. The guide block 32 is L-shaped. At the clamping position, the guide block 32 and the bottom portion of the guide rail 122 have an interacting normal force that is perpendicular to the top surface of the first connector 1*c*, which allows the second electrical terminal 40 of the second connector 3*c* and the first electrical terminals 20 of the first connector 1*c* to have enough normal force to reduce a contact resistance between the second electrical terminal 40 and the first electrical terminals 20.

Fourth Embodiment

Figure 17:
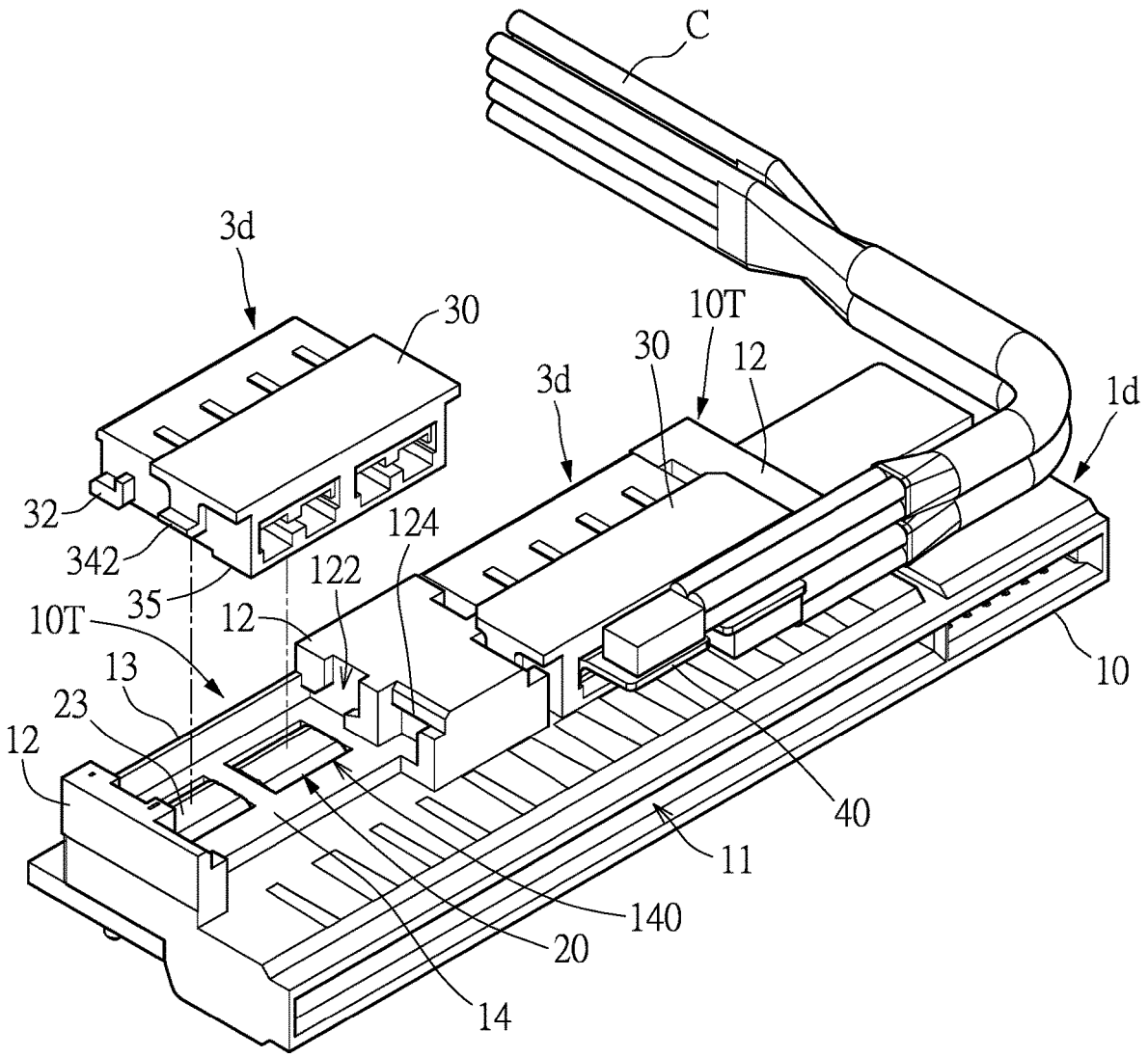
FIG. 17 is a perspective view showing the connector assembly having the shunt structure being partially assembled according to a fourth embodiment of the present disclosure.

Referring to FIG. 17, a fourth embodiment of the present disclosure provides a connector assembly having a shunt structure, which includes a first connector 1*d* and a second connector 3*d*. The first connector 1*d* includes the first insulating housing 10 and the plurality of first electrical terminals 20. The second connector 3*d* includes the second insulating housing 30. The present embodiment is almost the same as the previous embodiment. What is different from the previous embodiment is that the first electrical terminals 20 of the first connector 1*d* (being the same as those of the first embodiment) are exposed from the middle portion 23 in the exposed hole 140 of the exposed area 14. Preferably, a height of the middle portion 23 of the first electrical terminal 20 located in the exposed area 14 can be greater than heights of the middle portions 23 of the first electrical terminals 20 that are not located in the exposed area 14, in which the thickness of all the first electrical terminals 20 is the same. It is preferable for the middle portion 23 to be exposed out of the exposed hole 140 of the exposed area 14, so as to reduce a contact resistance between the first electrical terminals 20 and the second electrical terminal 40.

Fifth Embodiment

Figure 18:
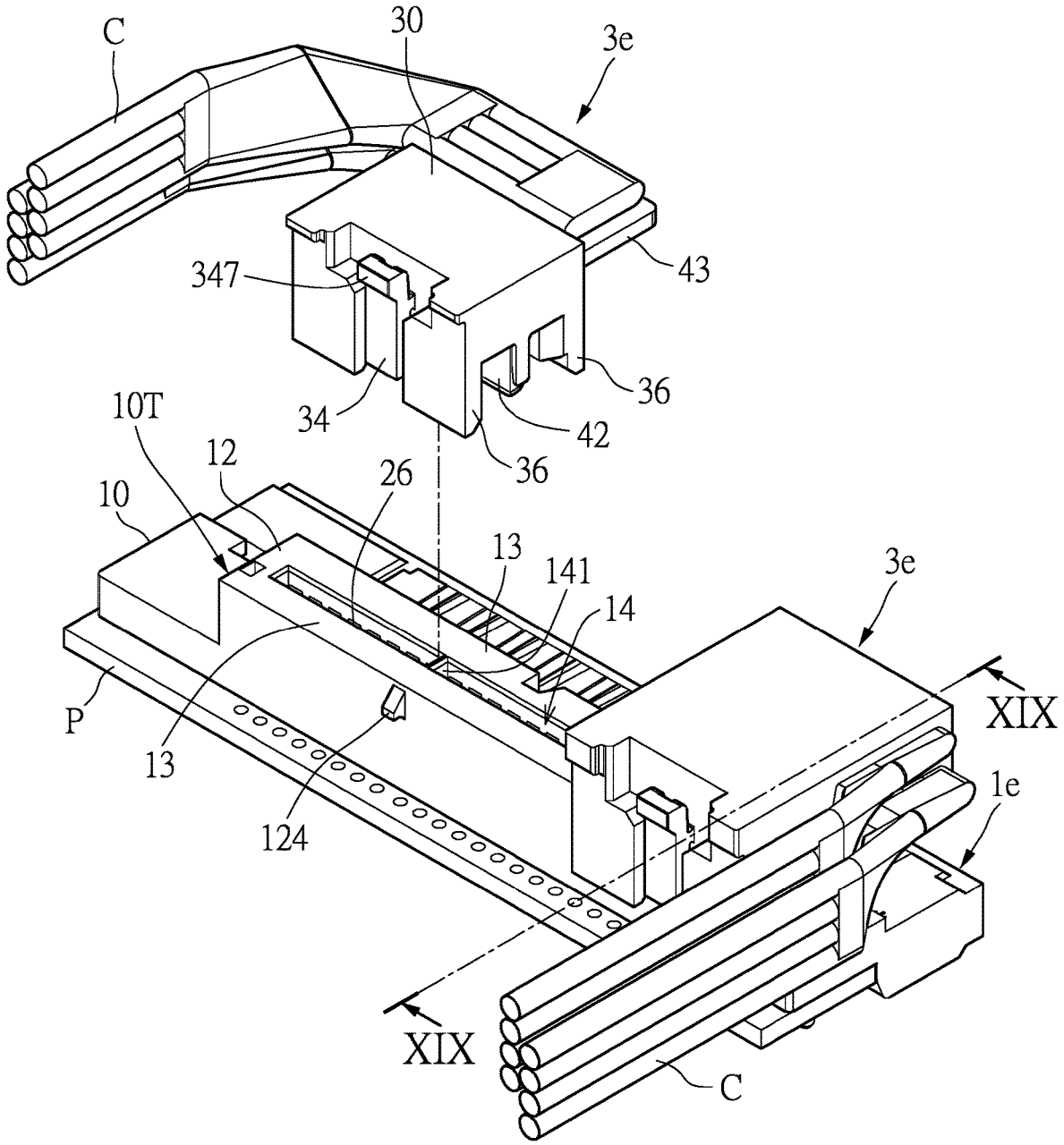
FIG. 18 is a perspective view showing the connector assembly having the shunt structure being partially assembled according to a fifth embodiment of the present disclosure.
Figure 19:
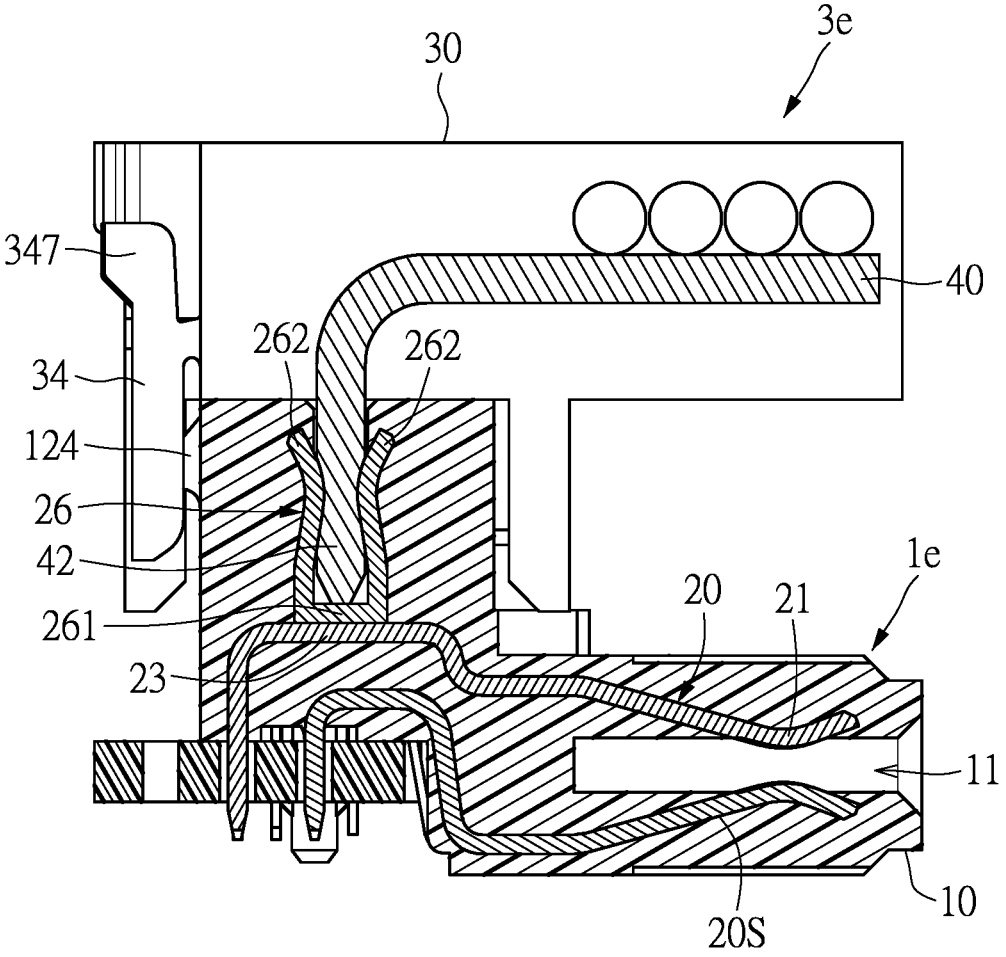
FIG. 19 is a sectional view taken along line XIX-XIX of FIG. 18 according to the present disclosure.

Referring to FIG. 18 and FIG. 19, a fifth embodiment of the present disclosure provides a connector assembly having a shunt structure, which includes a first connector 1*e* and a second connector 3*e*. The first connector 1*e* includes the first insulating housing 10 and the plurality of first electrical terminals 20. The second connector 3*e* includes the second insulating housing 30. The bottom view of the second insulating housing 30 is rectangular in shape.

What is different from the previous embodiment is that the adapter socket 10T has two lateral walls 13, two limiting side walls 12, and at least one exposed area 14 that is rectangular in shape. The two lateral walls 13 and the two limiting side walls 12 are connected and have the exposed area 14 surrounded therein. Each of the exposed areas 14 has a slot, and another end of the slot is in the exposed hole 140 on the top surface 101 of the first insulating housing 10 (not shown in the figures). Two adjacent slots are separated by a separating wall 141. In the present embodiment, the separating wall 141 is connected to the two lateral walls 13, and extends to a top surface of the adapter socket 10T to completely separate the two adjacent slots. The slots are in spatial communication with an input interface and an output interface of the first connector 1*e*. A length direction of the slots is parallel to a direction of the lateral walls 13. A forked contact member 26 is additionally disposed on a top surface of the middle portion 23 of the first electrical terminal 20. The forked contact member 26 has a level portion 261 and a pair of elastic arms 262. The elastic arms 262 respectively extend upward from two sides of the level portion 261 into the slot through the exposed hole 140. A plug space within the limiting side walls 12 and the lateral walls 13 is defined by the elastic arms 262, and the plug space is parallel to the two lateral walls 13. The level portion 261 is connected to the middle portion 23 of the first electrical terminal 20. In addition, the second contact portion 42 of the second electrical terminal 40 of the second connector 3*e* is plate-shaped, and is bent and extends downward. That is, the second electrical terminal 40 is L-shaped. The second insulating housing 30 has two blocking walls 36 additionally formed on two sides (preferably two long sides) of the second contact portion 42. The second contact portion 42 is parallel to the blocking walls 36, i.e., being parallel to long sides of the bottom of the second insulating housing 30. The clamping arm 34 is located on a side (preferably on a long side) of the second connector 3*e*.

In the present embodiment, during the assembling process, the second connector 3*e* is plugged into the first connector 1*e* from top to bottom, the second contact portion 42 located at the bottom of the second electrical terminal 40 is inserted into the middle of the forked contact member 26 and is electrically connected to the elastic arms 262, and the blocking walls 36 are located on outer sides of the two lateral walls 13. An engagement method of the present embodiment is different from the previous embodiment. In the present embodiment, the clamping arm 34 exhibits an elastic arm shape and is formed at the front end surface of the second insulating housing 30 (i.e., the long side of the rectangular second insulating housing 30). The clamping portion 124 is protruded from a front end surface of the first insulating housing 10 (i.e., being located on an outer surface of the lateral wall 13). When the second connector 3*e* is inserted downward to the clamping position, an end (a lower end) of the clamping arm 34 can be clamped with the clamping portion 124. The operator can press an upper end of the clamping arm 34 to remove the clamped state. In order for the operator to conveniently press the clamping arm 34, a pressing portion 347 is provided on the upper end of the clamping arm 34, and extends and protrudes outward from the clamping arm 34 (i.e., being distant from the second connector 3*e*). That is, the pressing portion 347 protrudes from the front end surface of the second insulating housing 30, which is convenient for the operator to make sure of a pressing point and an application of force when pressing. Furthermore, a location of the second insulating housing 30 that corresponds to the pressing portion 347 can also have a recessed space. The recessed space is formed by the front end surface of the second insulating housing 30 being concaved inward. In this way, when the operator presses the pressing portion 347 toward the second insulating housing 30, a fingertip of the operator can be accommodated.

Sixth Embodiment

Figure 20:
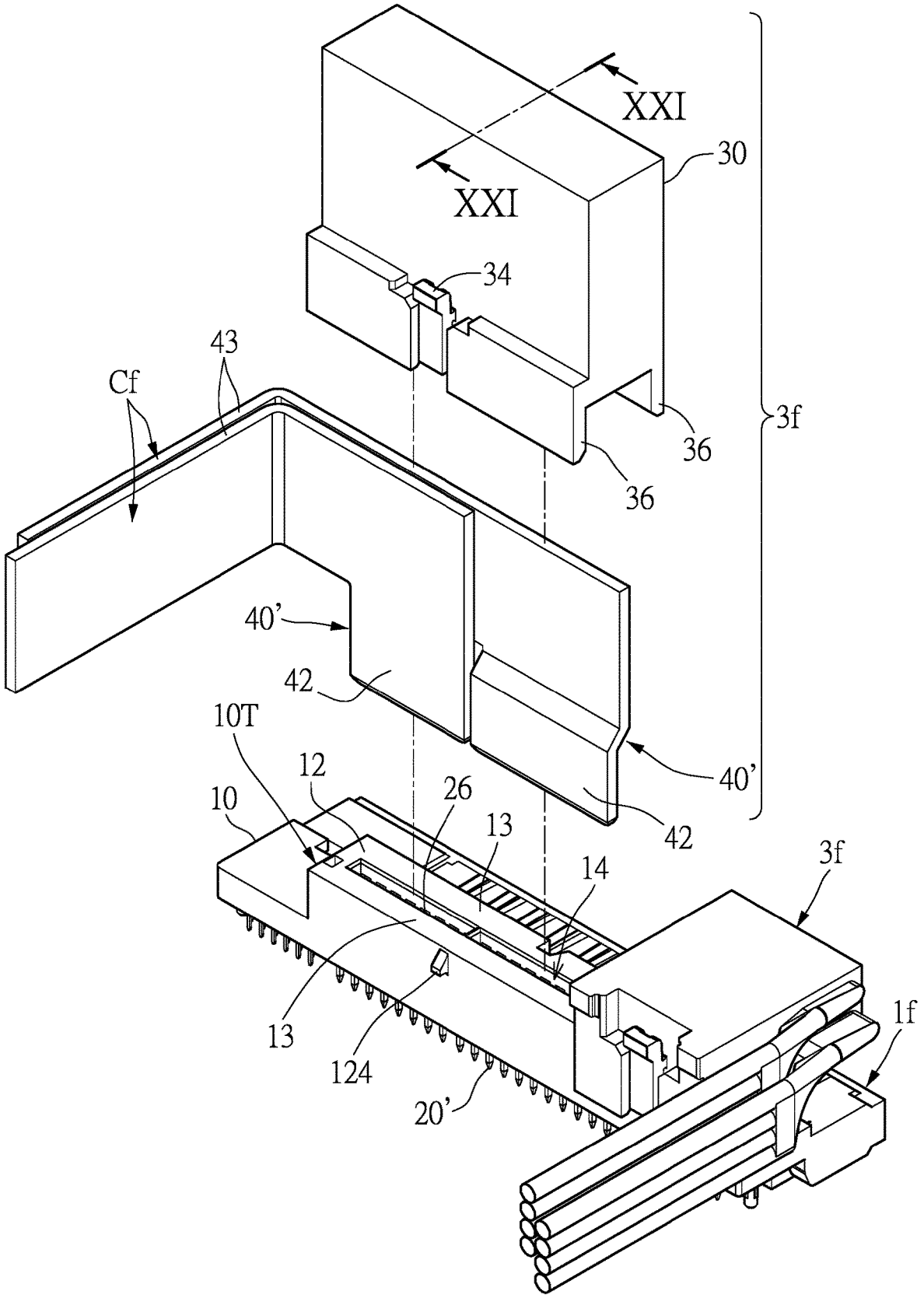
FIG. 20 is a perspective view showing the connector assembly having the shunt structure being partially assembled according to a sixth embodiment of the present disclosure.
Figure 21:
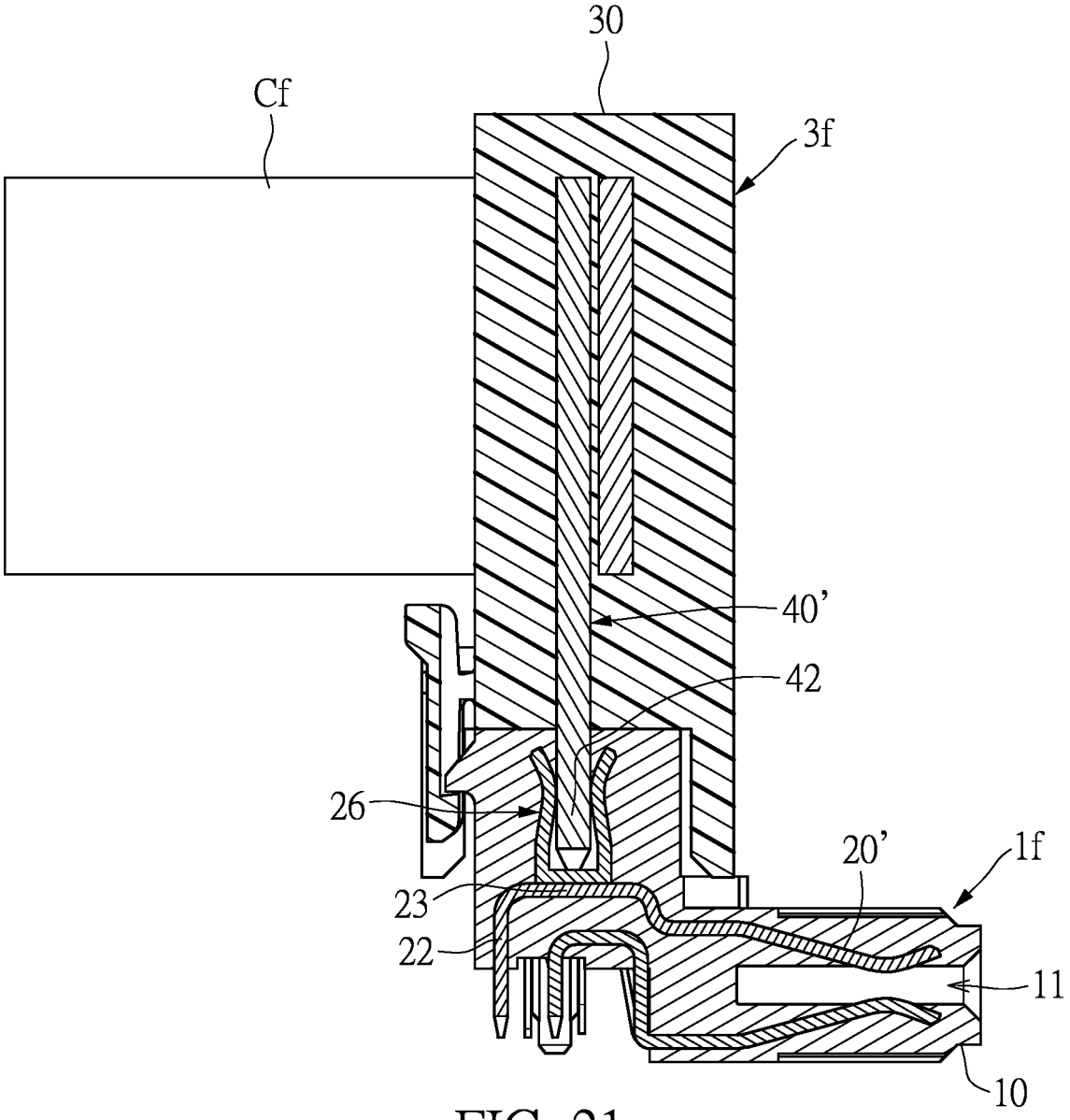
FIG. 21 is a sectional view taken along line XXI-XXI of FIG. 20 according to the present disclosure.

Referring to FIG. 20 and FIG. 21, a sixth embodiment of the present disclosure provides a connector assembly having a shunt structure, which includes a first connector 1*f* and a second connector 3*f*. The first connector 1*f* includes the first insulating housing 10 and the plurality of first power terminals 20'. The second connector 3*f* includes the second insulating housing 30. Similar to the previous embodiment, the adapter socket 10T includes the two lateral walls 13 and the two limiting side walls 12 that are arranged to form a rectangular shape, and at least one exposed area 14 disposed therein. Each of the exposed areas 14 has at least one slot configured therein, and another end of the slot is connected to the exposed hole 140. What is different from the previous embodiment is that no wire cable is used in the present embodiment. That is, instead of using stranded conductive fibers, plate metals Cf (e.g., copper bars) are used to transmit the electric current, so that a greater electric current can be transmitted. An end of the plate metals Cf is utilized as the second power terminals 40' in the second connector 3*f*, and the second contact portions 42 thereof are perpendicular to the bottom surface of the second insulating housing 30 and are inserted into the slot, so as to be electrically connected to the first power terminals 20' of the first connector 1*f* by being mated with at least one of the electrical terminals (i.e., the forked contact member 26) of the adapter socket 10T. In other words, the second power terminals 40' of the second connector 3*f* are an extension of the plate metals Cf. While one end of the second power terminals 40' (utilized as the second contact portions 42) is inserted into a corresponding slot of the adapter socket 10T, another end thereof (utilized as the second legs 43) extends out of the second insulating housing 30 and is electrically and directly connected to the electronic component without a wire cable. Referring to FIG. 20, since there are two slots located on the same plane, front ends of the second contact portions 42 of the second power terminals 40' are also located on the same plane. In order for the plate metals of the same direction to be arranged in a staggered manner, at least one of the plate metals Cf has a stepped structure configured along a direction that is perpendicular to a plate-shaped surface of the plate metals Cf (that is, being perpendicular to a direction of the slots in the present embodiment). In this way, the plate metals Cf are arranged in a staggered manner at positions which are perpendicular to the plate-shaped surface. The second legs 43 of the plate metals Cf each have at least one bent portion or are L-shaped, so that the plate metals Cf can change a direction along the adjacent two sides of the second insulating housing 30. Accordingly, the direction of the plate metals Cf can be adjusted when an overall size of the second connector 3*f* is at its minimum.

A clamping method of the present embodiment is similar to that of the previous embodiment, and will not be reiterated herein.

Seventh Embodiment

Figure 22:
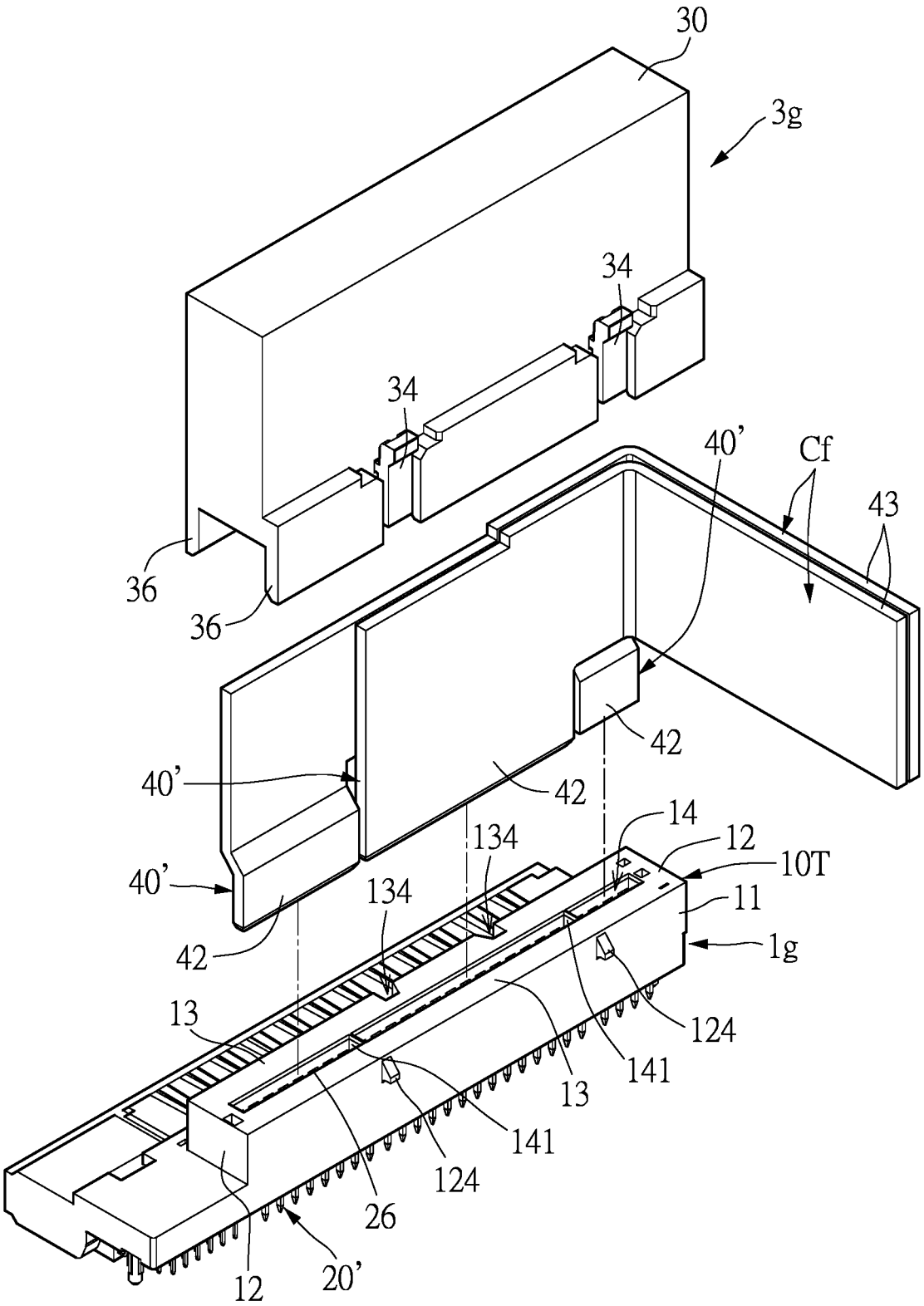
FIG. 22 is a perspective exploded view of the connector assembly having the shunt structure according to a seventh embodiment of the present disclosure.

Referring to FIG. 22, a seventh embodiment of the present disclosure provides a connector assembly having a shunt structure, which includes a first connector 1*g* and a second connector 3*g*. The first connector 1*g* includes the first insulating housing 10 and the plurality of first power terminals 20'. The second connector 3*g* includes the second insulating housing 30. An end (the second contact portion 42 which is located at the bottom of the second insulating housing 30) of the plate-shaped second power terminal 40' is inserted into the corresponding slot of the adapter socket 10T, and another end thereof is used as the second leg 43 to extend out of the rear end surface of the second insulating housing 30. The rear end surface and the bottom are adjacent to each other, and are preferably perpendicular to each other. What is different from the previous embodiment is that one of the two second power terminals 40' have two second contact portions 42, which are configured on left and right sides of the second contact portion 42 of another one of the two second power terminals 40'. The middle second contact portion 42 is inserted into a middle slot of the adapter socket 10T, and the second contact portions 42 on the left and right sides are respectively inserted into two slots on left and right sides. The two slots are each separated from the middle slot by the separating wall 141. One of the two second power terminals 40' is electrically connected to the power potential, and another one of the second power terminals 40' is electrically connected to the ground potential. For example, the second power terminal 40' that has the two second contact portions 42 on the left and right sides is electrically connected to the ground potential, and the second power terminal 40' that has the middle second contact portion 42 is electrically connected to the power potential. The lateral wall 13 is configured to have at least one guide slot 134, and the second connector 3*g* has a corresponding guided portion (not shown in the figures) that is located on a long side of the rectangular second insulating housing 30. When the second connector 3*g* is inserted into the adapter socket 10T, the guided portion slides along the guiding slot 134 to provide a positioning function. A clamping method of the present embodiment is similar to that of the sixth embodiment, in which multiple groups of the clamping arms 34 and the clamping portions 124 are provided.

Eighth Embodiment

Figure 23:
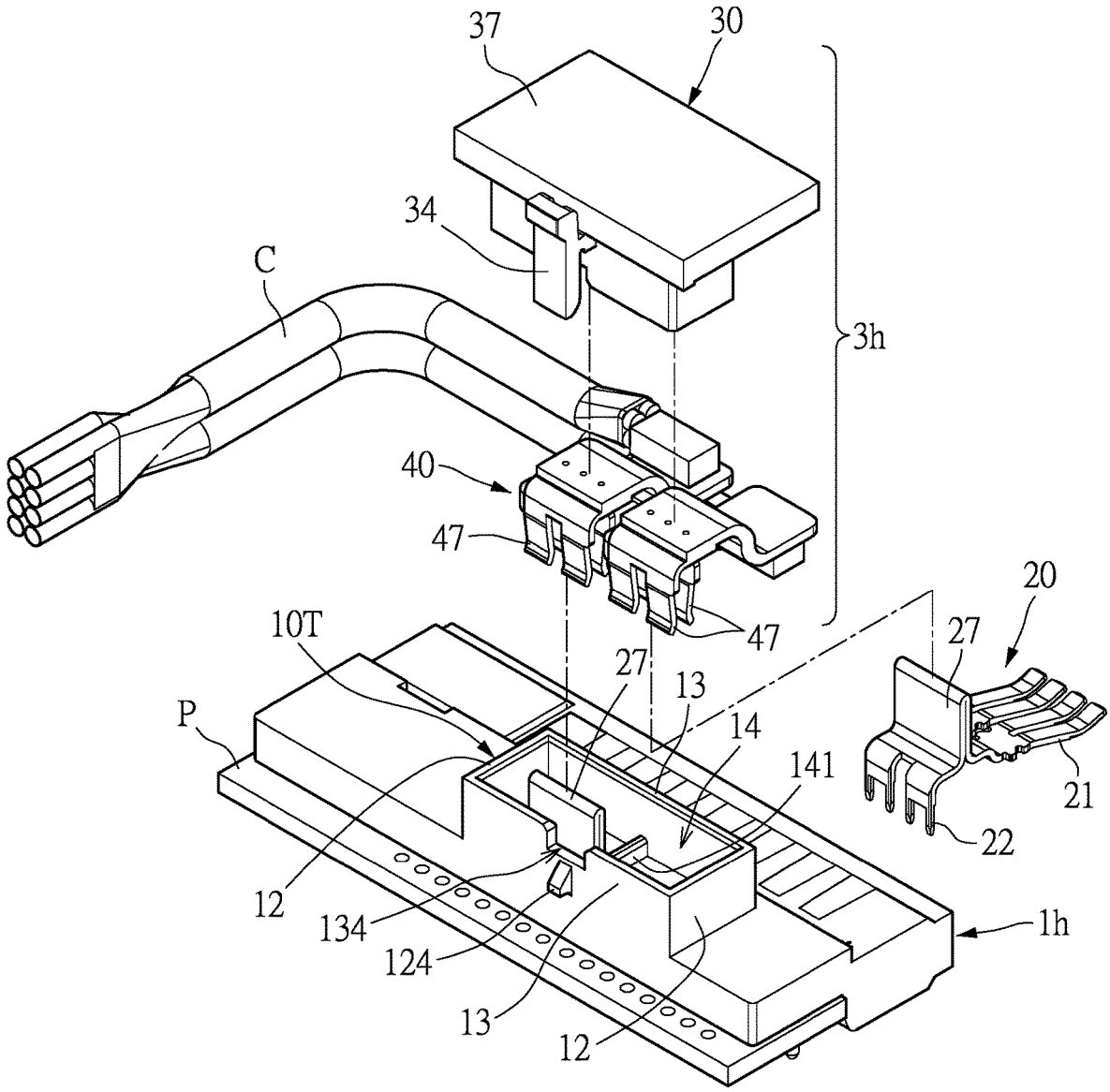
FIG. 23 is a perspective exploded view of the connector assembly having the shunt structure according to an eighth embodiment of the present disclosure.
Figure 24:
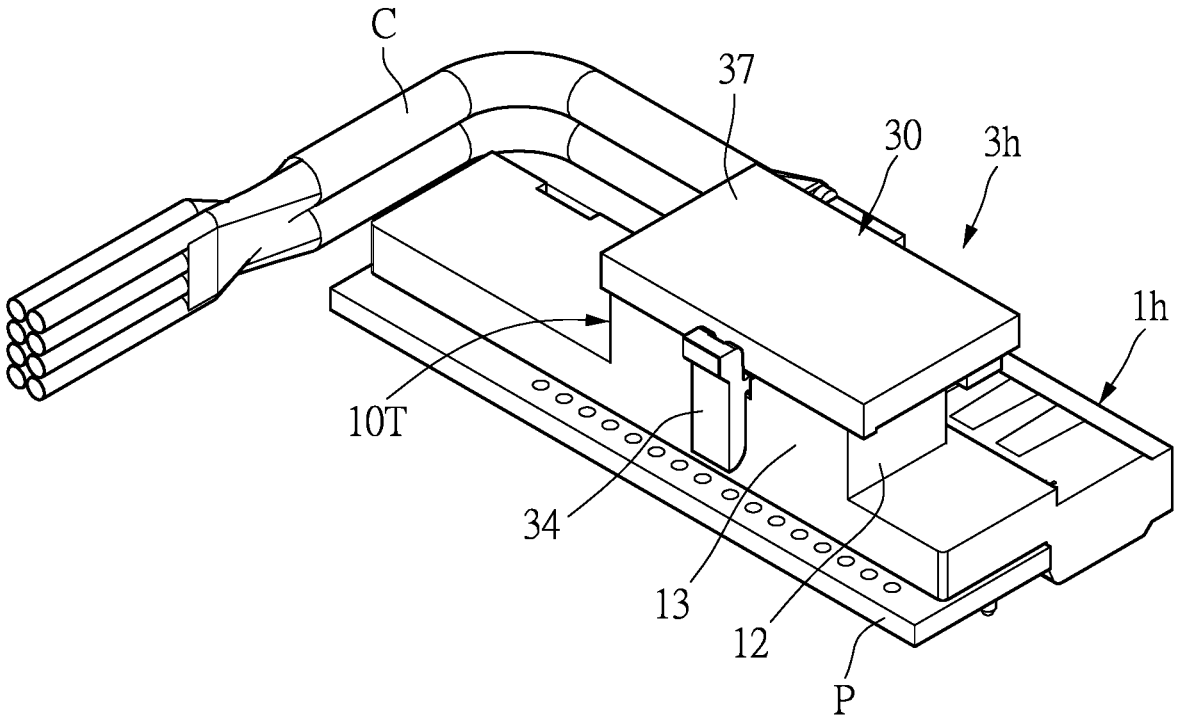
FIG. 24 is a perspective assembled view of the connector assembly having the shunt structure according to the eighth embodiment of the present disclosure.
Figure 25:
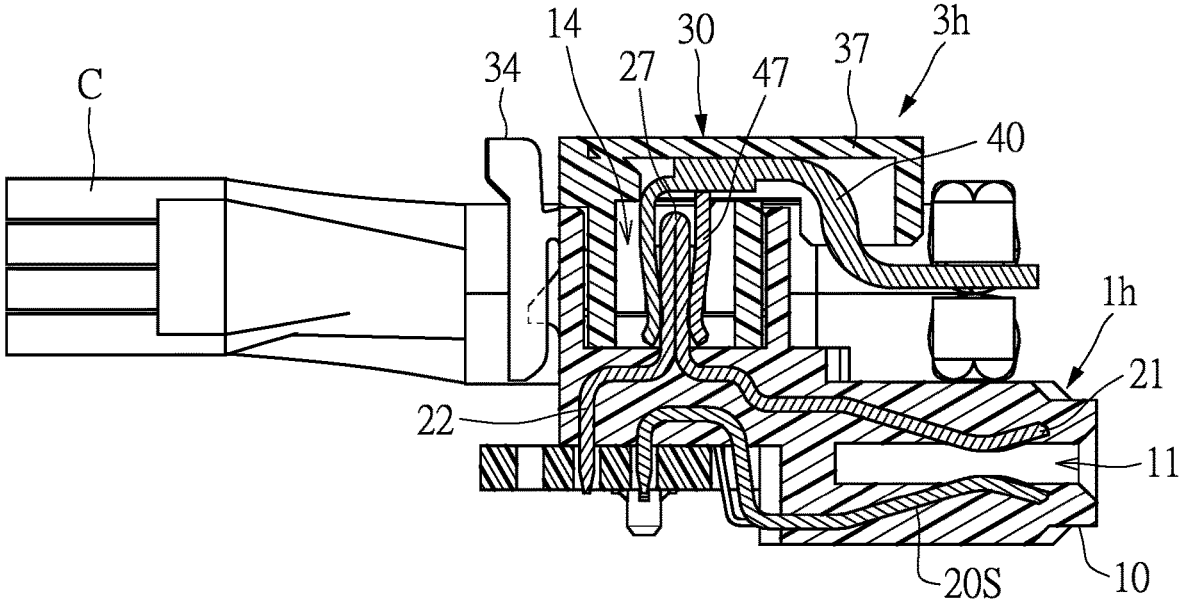
FIG. 25 is a sectional view taken along line XXV-XXV of FIG. 24 according to the present disclosure.

Referring to FIG. 23 to FIG. 25, an eighth embodiment of the present disclosure provides a connector assembly having a shunt structure, which includes a first connector 1*h* and a second connector 3*h*. The first connector 1*h* includes the first insulating housing 10 and the plurality of first electrical terminals 20. The second connector 3*h* includes the second insulating housing 30, and the bottom of the second insulating housing 30 is rectangular in shape. What is different from the previous embodiment is that the first electrical terminals 20 have an upward protruding middle portion 27 formed between the first contact portions 21 and the first legs 22. Specifically speaking, the middle portion 27 can be a folded metal plate. Two ends of the metal plate are connected to the first contact portions 21 and the first legs 22, respectively. After being folded, a middle of the metal plate protrudes upward. In other words, the middle portion 27 is a single connection plug disposed in the rectangular exposed area 14. At least one slot is defined in the exposed area 14, while two adjacent slots are separated from each other by the separating wall 141. In the present embodiment, a height of the separating wall 141 is less than a height of the middle portion 27. That is, the separating wall 141 does not extend to the top surface of the adapter socket 10T. The middle portion 27 is located in a middle of the corresponding slot, i.e., being between the two lateral walls 13 and being parallel to the two lateral walls 13. The middle portion 27 is plate-shaped and is parallel to the length direction of the slots. In addition, second contact portions 47 of the second electrical terminal 40 have a plurality of elastic arms that are arranged in two rows and have a fork-shaped structure. A clutching surface is defined by the second contact portions 47, so as to clutch the folded middle portion 27. The clutching surface is perpendicular to the bottom surface of the second insulating housing 30, and is parallel to the long sides of the bottom of the second insulating housing 30. The lateral wall 13 is configured to have at least one guide slot 134, which allows the second connector 3*h* to be positioned when the second connector 3*h* is inserted into the adapter socket 10T. The guide slot 134 and the clamping portion 124 are located on the same vertical surface (that is, the guided portion of the second insulating housing 30 and the clamping arm 34 are located on the same vertical surface). Or, the guide slot 134 and the clamping portion 124 can be respectively located on vertical surfaces that are opposite to each other (that is, the guided portion of the seconding insulating housing 30 and the clamping arm 34 are located on vertical surfaces that are opposite to each other), so as to provide a more stable positioning function. A cover body 37 is provided on the head of the second connector 3*h* (a top that is opposite to the bottom). That is, a lower portion of the second insulating housing 30 has four sides forming a rectangular shape, and the second contact portions 47 are located within the four sides. A top part of an upper portion of the second insulating housing 30 has four sides horizontally protruding to form the cover body 37. An area of the cover body 37 is greater than an area of the bottom surface of the second insulating housing 30. Therefore, when the second connector 3*h* is inserted into the adapter socket 10T, a cover-like structure can completely shield the exposed area 14, and the four sides forming the rectangular shape are located in the adapter socket 10T. That is, the lower portion of the second insulating housing 30 is inserted into the adapter socket 10T, and the lateral walls 13 and the limiting side walls 12 surround the four sides of the lower portion of the second insulating housing 30. In this way, there is a stable connection between the adapter socket 10T and the second insulating housing 30, thereby providing a positioning function.

It should be noted that the second insulating housing 30 can function as a protective cover for the adapter socket 10T by not including the second electrical terminal 40. When the adapter socket 10T does not need to perform current shunting, the second insulating housing 30 without the second electrical terminal 40 can be inserted into the adapter socket 10T, and the cover body 37 is provided on the top surface of the second insulating housing 30, so as to shield the exposed area 14 or the slots of the adapter socket 10T. In this way, dust can be prevented from falling onto the adapter socket 10T, or the operator can be prevented from accidentally touching the adapter socket 10T and suffering an electric shock. Further, the second insulating housing 30 includes the clamping arm 34, which can be fastened with the clamping portion 124 of the adapter socket 10T, so as to prevent falling off.

Ninth Embodiment

Figure 26:
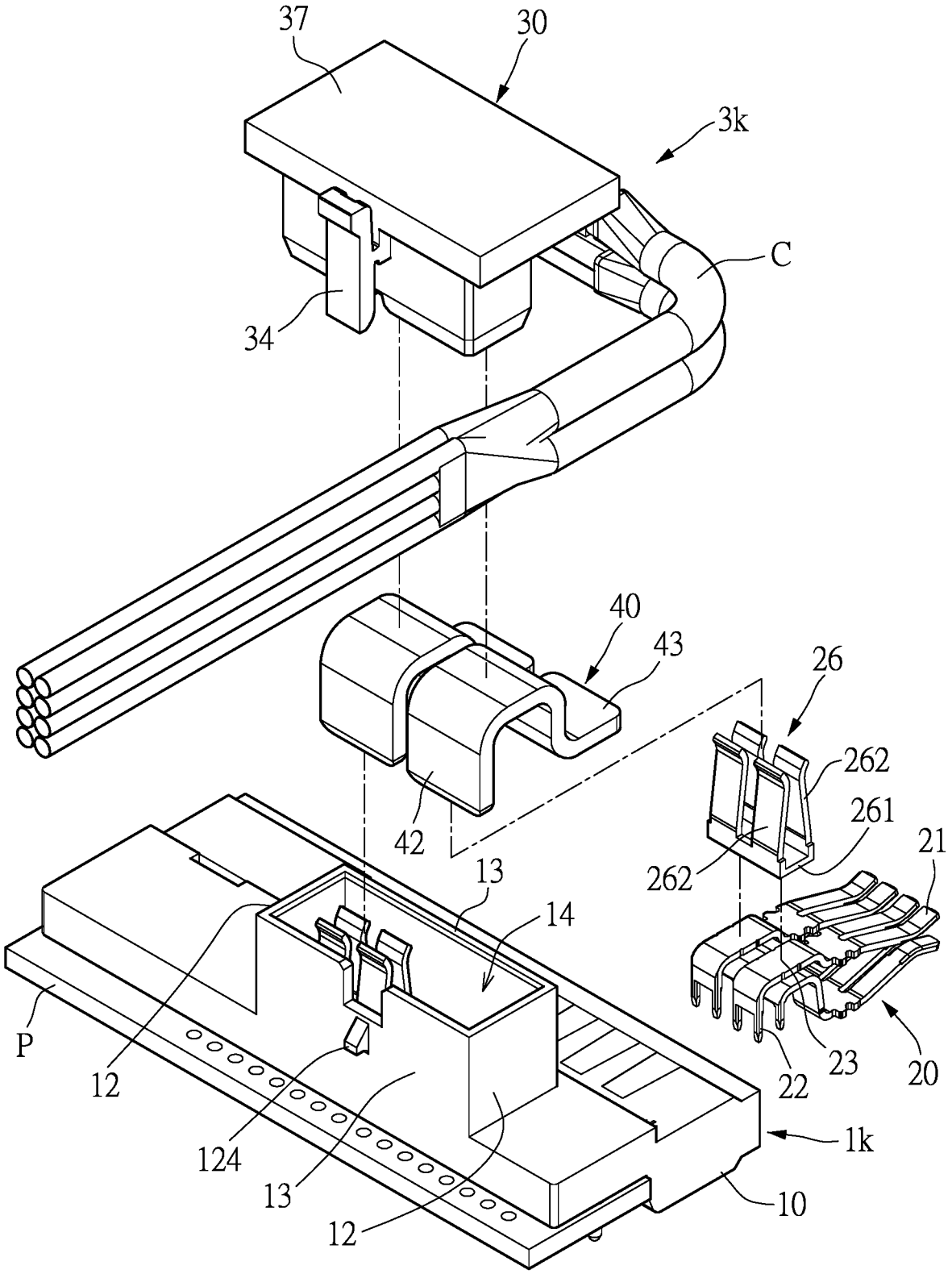
FIG. 26 is a perspective exploded view of the connector assembly having the shunt structure according to a ninth embodiment of the present disclosure.
Figure 27:
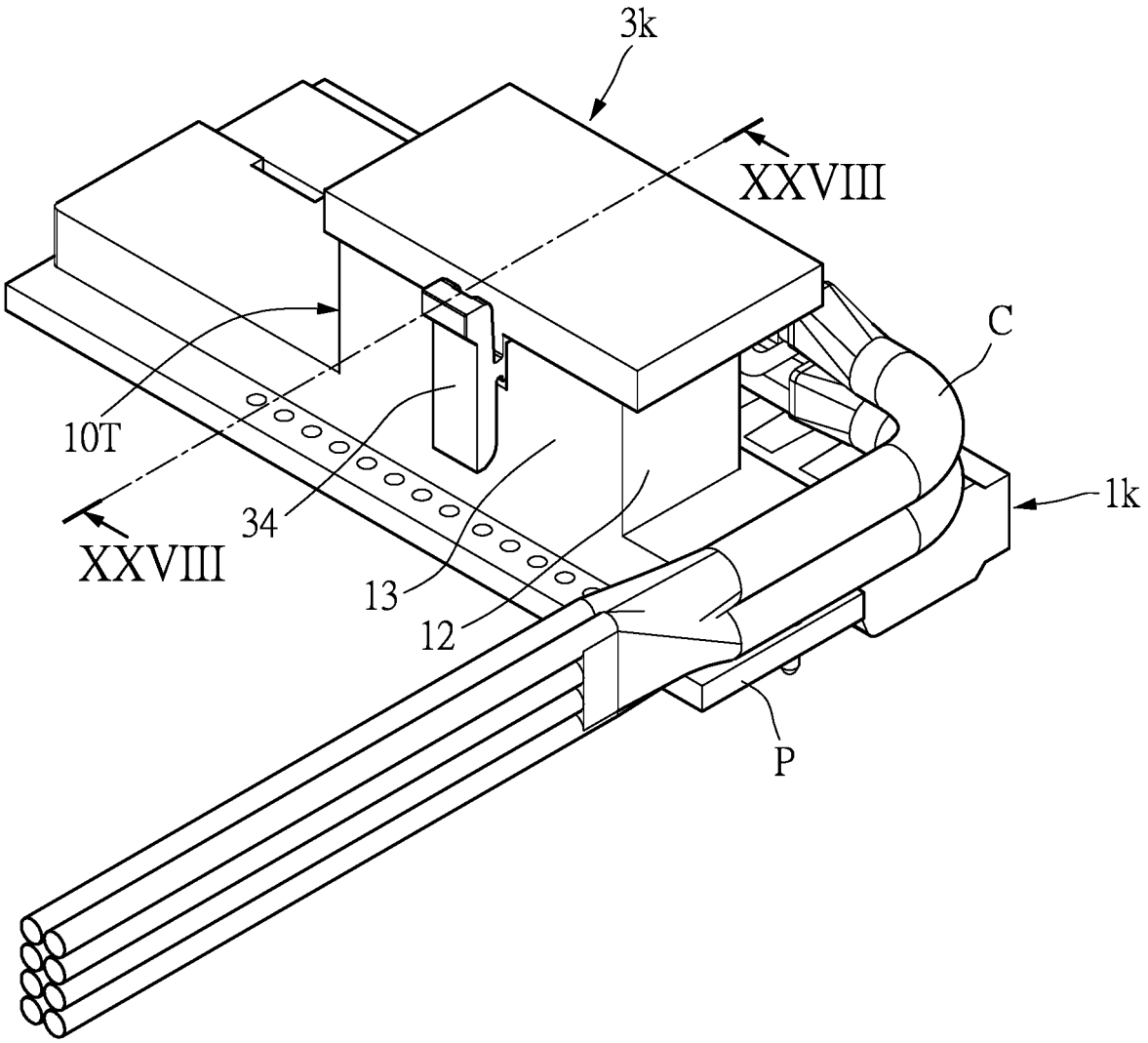
FIG. 27 is a perspective assembled view of the connector assembly having the shunt structure according to the ninth embodiment of the present disclosure.
Figure 28:
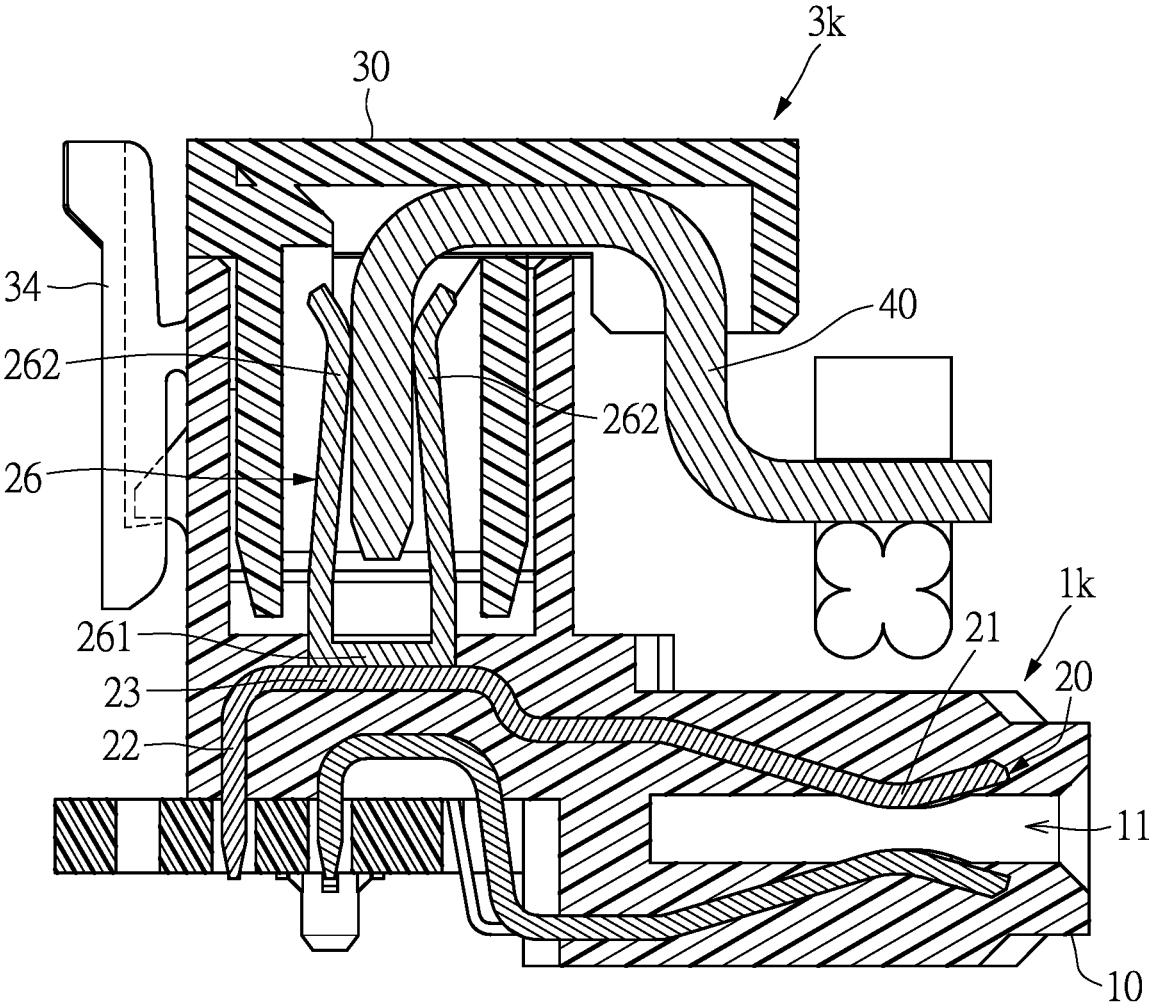
FIG. 28 is a sectional view taken along line XXVIII-XXVIII of FIG. 27 according to the present disclosure.

Referring to FIG. 26 to FIG. 28, a ninth embodiment of the present disclosure provides a connector assembly having a shunt structure, which includes a first connector 1*k* and a second connector 3*k*. The first connector 1*k* includes the first insulating housing 10 and the plurality of first electrical terminals 20. The second connector 3*k* includes the second insulating housing 30.

Similar to the fifth embodiment, the forked contact member 26 is additionally disposed on the top surface of the middle portion 23 of the first electrical terminals 20. The forked contact member 26 has the level portion 261 and the pair of elastic arms 262 that respectively extend out of the exposed hole 140 from the two sides of the level portion 261 in an upward direction. The first electrical terminals 20 can be a two-piece configuration, and the level portion 261 is connected to the middle portion 23 of the two-piece first electrical terminals 20. In addition, the second contact portion 42 of the second electrical terminal 40 of the second connector 3*k* is plate-shaped. After the second connector 3*k* is plugged into the first connector 1*k*, the forked contact member 26 clutches the plate-shaped second contact portion 42.

Tenth Embodiment

Figure 29:
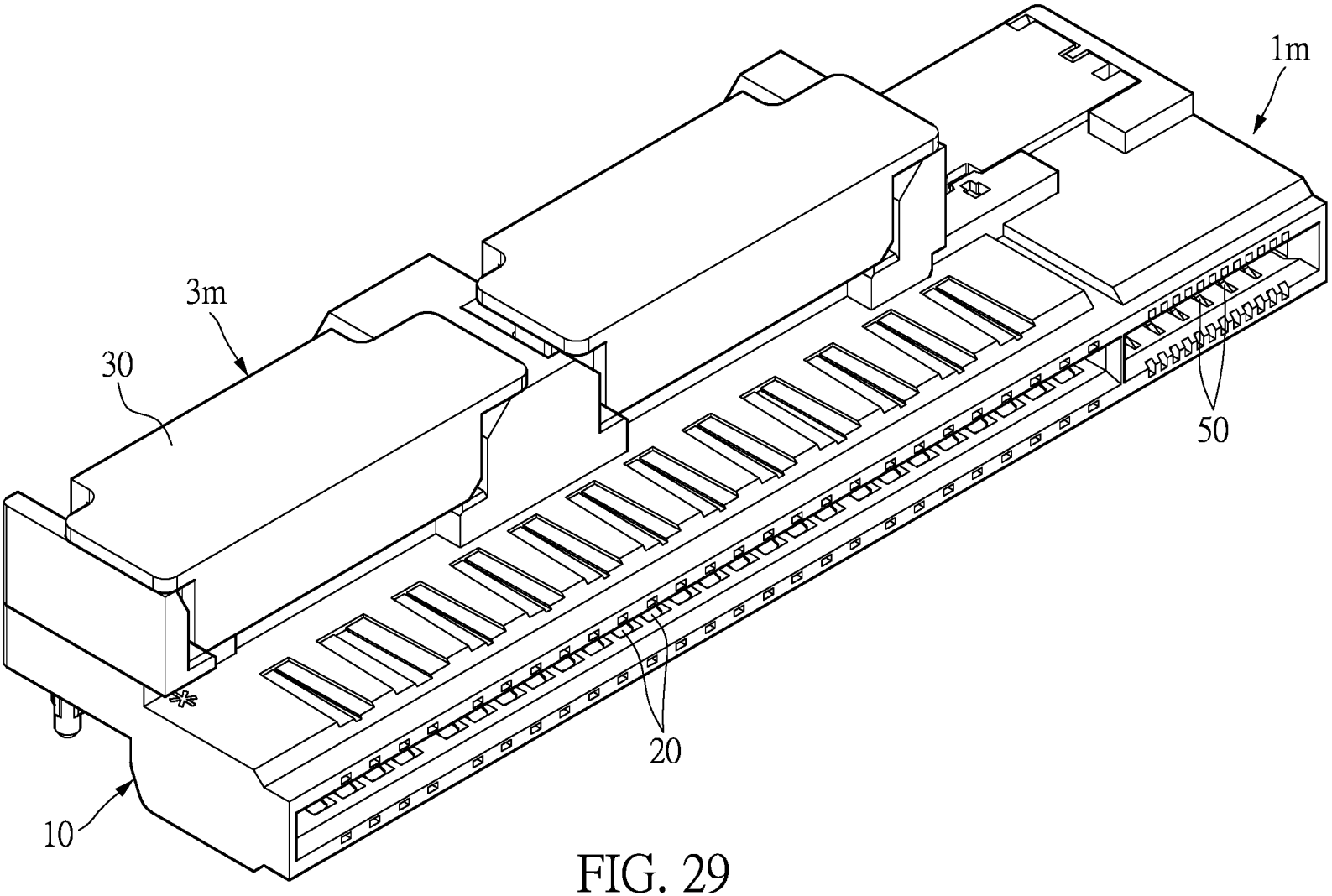
FIG. 29 is a perspective assembled view of the connector assembly having the shunt structure according to a tenth embodiment of the present disclosure.
Figure 30:
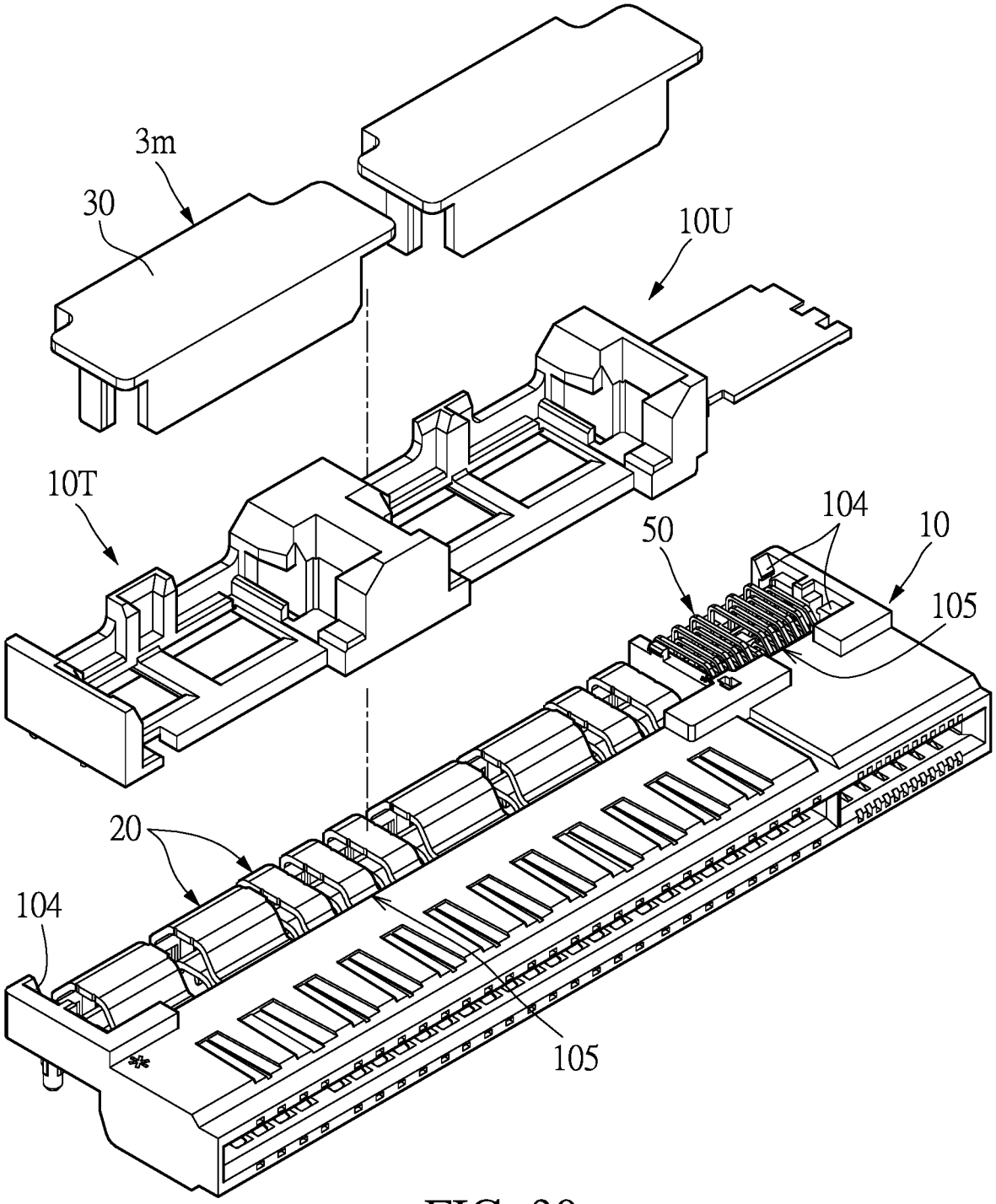
FIG. 30 is a perspective exploded view of the connector assembly having the shunt structure according to the tenth embodiment of the present disclosure.
Figure 31:
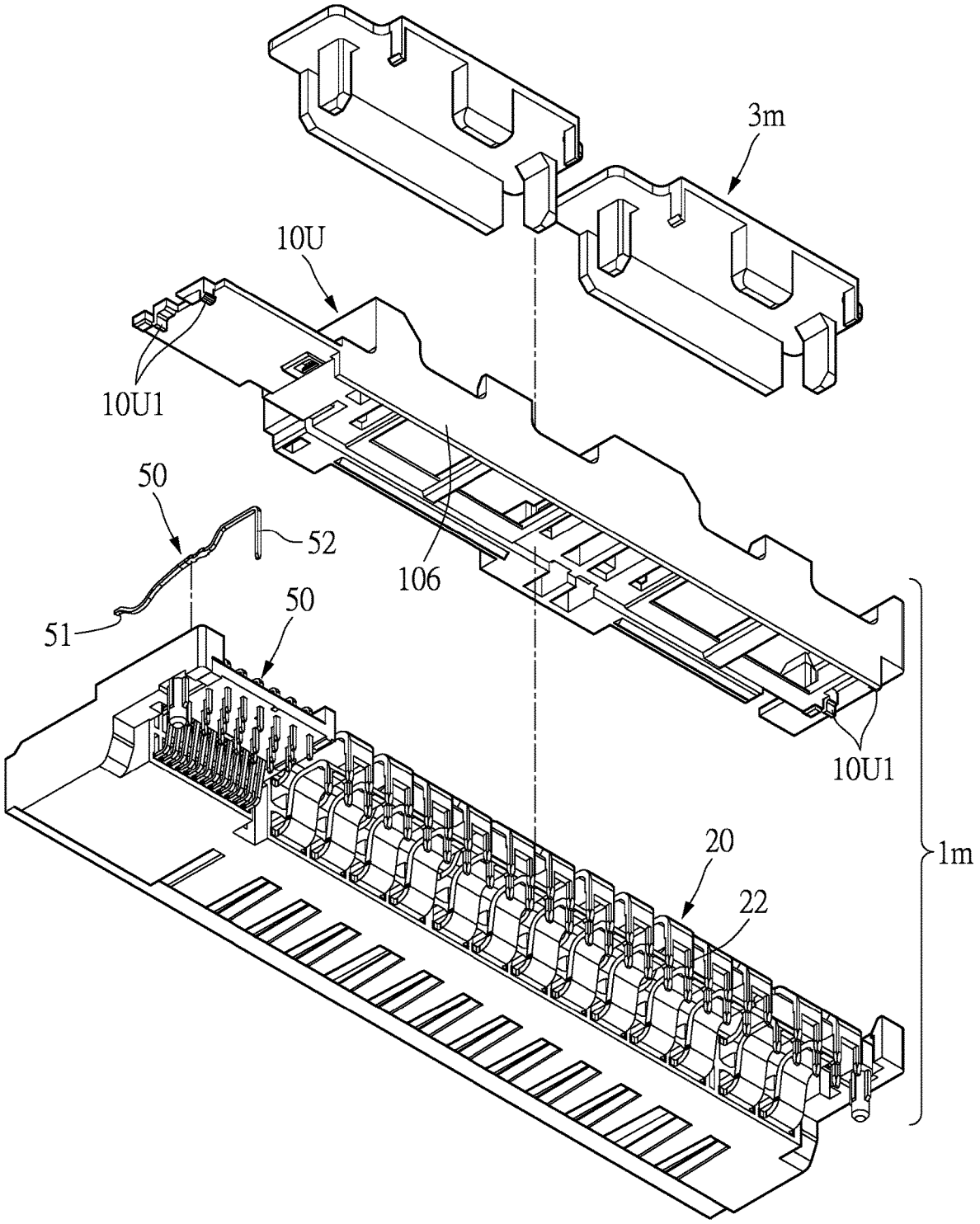
FIG. 31 is another perspective exploded view of the connector assembly having the shunt structure according to the tenth embodiment of the present disclosure.

Referring to FIG. 29 to FIG. 31, a tenth embodiment of the present disclosure provides a connector assembly having a shunt structure, which includes a first connector 1*m* and a second connector 3*m*. The first connector 1*m* includes the first insulating housing 10, the plurality of first electrical terminals 20, and a plurality of first signal terminals 50. The second connector 3*m* includes the second insulating housing 30. The first connector 1*m* has two input interfaces, one of which being a power input interface and another one of which being a signal input interface. Similarly, the first connector 1*m* has two output interfaces, one of which being a power output interface and another one of which being a signal output interface.

The power input interface and the signal input interface are both located at a first side surface of the first connector 1*m*, and are two independent slots. The first signal terminals 50 each have a first signal contact portion 51 that extends to the slot (i.e., inside the signal input interface) and a first signal pin 52 that extends to the bottom surface 102 of the first insulating housing 10 (i.e., the signal output interface). The first signal contact portion 51 and the first signal pin 52 are electrically connected to each other. The first signal terminals 50 are pins that can be used to transmit electric current signals less than 0.5 A.

The first insulating housing 10 includes a shunt socket 10U. What is different from the previous embodiment is that, in the present embodiment, the shunt socket 10U and the first insulating housing 10 are separately formed and are then assembled into one body. The shunt socket 10U has a base, and the base is clamped onto a third side surface of the first connector 1*m*. Specifically, a bottom surface of the base of the shunt socket 10U has at least one fastening portion 10U1, and the first insulating housing 10 has at least one corresponding fastening member 104. When the shunt socket 10U and the first insulating housing 10 are assembled into one body, the at least one fastening portion 10U1 and the at least one fastening member 104 engage with each other, thereby allowing the shunt socket 10U to be detachably fixed on the first insulating housing 10. The shunt socket 10U is rectangular in shape, and has two long sides and two short sides. It is preferable for the fastening portion 10U1 to be plural in numbers, each of which being located on the two short sides and/or the two long sides. It should be noted that the fastening portions 10U1 of the present embodiment are located on two ends of the short sides and extend downward from the bottom surface of the base. A front end of the fastening portion 10U1 has a fastening body that extends along a horizontal direction (preferably extending outward).

A long side of the base of the shunt socket 10U extends downward to form an extending wall 106. An inner surface of the extending wall 106 abuts against a side surface of the first insulating housing 10. In addition, a lower surface of the base of the shunt socket 10U (preferably a lower surface of another long side opposite to the extending wall 106) is partially in contact with part of an upper surface of the top surface 101 of the first insulating housing 10. In this way, when the shunt socket 10U suffers an external force, part of the external force can be transmitted to the first insulating housing 10, so as to enhance a stability of the shunt socket 10U being fixed to the first insulating housing 10. In the present embodiment, the extending wall 106 is located at an outer side of the first legs 22 of the first electrical terminals 20, so as to protect the first legs 22.

The third side surface of the first connector 1*m* has at least one shunt hole 105, so as to expose at least one of the first electrical terminals 20 and/or at least one of the first signal terminals 50. At least one adapter socket 10T is disposed on the shunt socket 10U and corresponds to the at least one shunt hole 105 (i.e., the shunt hole 105 that corresponds to the first electrical terminals 20 and/or the shunt hole 105 that corresponds to the first signal terminals 50). Each of the adapter sockets 10T has at least one exposed hole. Preferably, the shunt socket 10U completely or partially shields all the shunt holes configured on the third side surface. Only the exposed hole of the adapter socket 10T exposes corresponding first electrical terminals 20 and/or the first signal terminals 50, or the first electrical terminals 20 and/or the first signal terminals 50 extend outward from the corresponding shunt hole 105. If the adapter socket 10T partially shields the shunt hole 105, the unshielded part of the shunt hole 105 can function as the heat dissipation through hole, so as to increase the heat dissipation effect. A structure of each of the adapter sockets 10T and the second connector 3*m* can be understood from the descriptions provided in each of the previous embodiments, and will not be reiterated herein.

It should be noted that, while the heat dissipation groove or the heat dissipation through hole is not specifically drawn in the figures for the fifth embodiment to the tenth embodiment of the present disclosure, at least one of the heat dissipation groove or the heat dissipation through hole can be configured in the second insulating housing 30 (preferably being parallel or perpendicular to the bottom surface) in an actual application, as shown in the first to the fourth embodiments.

Beneficial Effects of the Embodiments

One of the beneficial effects of the present disclosure is that, the connector having the shunt structure provided by the present disclosure can allow the electric current of the first connector to be transmitted to the second electrical terminal of the second connector through the first electrical terminals, and then be transmitted to other components that require the electric current via the wire cables or the plate metals. In the present disclosure, one single first connector can be used for providing the electric current through the circuit board or the second connector.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A connector having a shunt structure, comprising:

an insulating housing having a first side surface and a second side surface, wherein the first side surface has a plug input interface provided for insertion of a power supply component along a first direction, the first side surface is rectangular in shape, a length direction of the first side surface is parallel to a second direction, and the second side surface has an output interface; wherein the first direction is perpendicular to the second direction;

a plurality of electrical terminals, wherein each of the electrical terminals has one of a plurality of first contact portions and one of a plurality of first legs, each of the first contact portions extends into the plug input interface along the first direction, and each of the first legs extends to the output interface; and a first shunt socket located on a third side surface of the insulating housing and corresponding to a shunt hole of the third side surface, wherein the shunt hole allows a surface of at least one of the electrical terminals to be partially exposed and become a shunt contact surface, and the shunt contact surface is parallel to the second direction; wherein the first shunt socket includes a first positioning member, such that a second connector is positioned on the first shunt socket when the second connector is inserted into the first shunt socket.

2. The connector according to claim 1, further comprising a second shunt socket provided for insertion of a third connector, so as to be electrically connected to the at least one of the electrical terminals; wherein the second shunt socket includes a second positioning member to be mated with a positioning portion of the third connector, and the first positioning member of the first shunt socket is not compatible with the positioning portion of the third connector.

3. The connector according to claim 2, wherein the at least one of the electrical terminals corresponding to the first shunt socket supplies a power potential, and the at least one of the electrical terminals corresponding to the second shunt socket supplies a ground potential.

4. The connector according to claim 1, further comprising a second shunt socket provided for insertion of a third connector, so as to be electrically connected to the at least one of the electrical terminals; wherein the first shunt socket includes a first mistake-proofing key, the second shunt socket includes a second mistake-proofing key, and the first mistake-proofing key and the second mistake-proofing key are different from one another.

5. The connector according to claim 1, wherein the first shunt socket has two limiting side walls, and each of the two limiting side walls has a clamping portion provided for engagement with a clamping arm on each of two sides of the second connector when the second connector is inserted to a clamping position in the first shunt socket; wherein each of the clamping portions has a clamping surface, and the clamping surface is parallel to the shunt contact surface.

6. The connector according to claim 1, wherein the at least one of the electrical terminals exposed from the shunt hole includes an electrical terminal that supplies a power potential and another electrical terminal that supplies a ground potential.

7. The connector according to claim 1, wherein, in a direction that is perpendicular to the first direction, an outer height of the shunt contact surface of the at least one of the electrical terminals exposed from the shunt hole is greater than heights of corresponding surfaces of remaining ones of the electrical terminals.

8. The connector according to claim 1, wherein the first shunt socket has two limiting side walls, the two limiting side walls each have a first side end and a second side end opposite to the first side end, and each of the two limiting side walls has a non-linear guide rail and a clamping portion respectively located on the first side end and the second side end.

9. The connector according to claim 1, wherein the plurality of electrical terminals is divided into multiple pairs of first electrical terminals and second electrical terminals, the first contact portions of each pair of the first electrical terminal and the second electrical terminal form a slot that is parallel to the first direction, and the first contact portions each have a plurality of elastic arms.

10. The connector according to claim 1, wherein the first shunt socket and the insulating housing are separately formed.

11. The connector according to claim 10, wherein the first shunt socket has a base, and the base is clamped onto the third side surface.

* * * * *